US006108918A

United States Patent [19]

Ye

[11] Patent Number: 6,108,918

[45] Date of Patent: Aug. 29, 2000

[54] METHOD AND APPARATUS FOR MAKING SWAGS

[75] Inventor: Min Ye, Gastonia, N.C.

[73] Assignee: R. H. Rowley Company, Gastonia, NC

[21] Appl. No.: 09/058,073

[22] Filed: Apr. 9, 1998

[51] Int. Cl.[7] ..... G01B 3/14; A41H 3/00

[52] U.S. Cl. ..... 33/12; 33/13; 33/563

[58] Field of Search ..... 33/11, 12, 13, 33/17 R, 562, 563, 565, 566

[56] References Cited

U.S. PATENT DOCUMENTS

| | | | |
|---|---|---|---|
| 3,545,085 | 12/1970 | Stewart | 33/12 |
| 3,664,026 | 5/1972 | Lawson . | |
| 4,265,020 | 5/1981 | Werber . | |
| 4,817,292 | 4/1989 | Callahan . | |
| 4,986,005 | 1/1991 | Grippi et al. . | |
| 5,094,006 | 3/1992 | Varney . | |
| 5,881,471 | 3/1999 | Kaluza | 33/13 |
| 5,943,974 | 8/1999 | Hoag | 33/566 |

OTHER PUBLICATIONS

Selected pages from Swags & Cascades, "Traditional Swags & Cascades," pp. 115–125 No Date.

Dec. 1994 Advertisement from Cornfab, for "Cornfabl" computer program for Windows.

From Parkhill International Ltd., The "PARKHILL Royal" Adjustable Swag Template No Date.

OB/MASCO, Mark VII, "Swag Master: Instruction Manual for Making the Lined & Unlined Swag" No Date.

*Primary Examiner*—Andrew H. Hirshfeld

*Attorney, Agent, or Firm*—Kennedy Covington Lobdell & Hickman, LLP

[57] ABSTRACT

A method of outlining a swag body on fabric includes overlaying a first unadjustable template sheet formed of durable plastic over fabric and partially outlining top and bottom portions of the swag body on the fabric, removing the first template, and then overlaying a second unadjustable template sheet formed from durable plastic over the fabric and further outlining a side portion of the swag body. The first template includes top demarcation lines for outlining the top portion of traditional swag bodies and cut-out demarcation lines for outlining the top portion of cut-out swag bodies. The first template further includes corner demarcation lines for outlining an upper corner side portion of traditional swag bodies. Each demarcation line corresponds to a particular swag drop and demarcation lines include apertures corresponding to swag widths. The first template can thereby accommodate the formation of swag bodies having various swag dimensions of swag drop and swag width as well as various swag styles. The second template includes indicia for orienting the template with respect to the outline made with the first template and for further outlining a side portion of the swag body and also can be used with swag bodies of various swag drops and swag widths. The second template includes an angular side edge for outlining triangular portions defining the side edge of the swag body which are later folded to form pleats, and is dimensioned to form a predetermined number of triangular portions for the formation of a predetermined number of pleats.

45 Claims, 20 Drawing Sheets

METHOD AND APPARATUS FOR MAKING SWAGS

BACKGROUND OF THE PRESENT INVENTION

The present invention relates broadly to a method and apparatus for making swags for decorative partial coverage of windows, doors, stages, beds and the like and, more particularly, to a method and apparatus for making an outline on a planar length of fabric of a swag body which, when folded and hung, will form a finished swag having preselected swag dimensions.

Swags are gathered, curved pieces of material that are suspended from poles or boards over a window, door, stage, or bed to drape naturally under the force of gravity to partially cover the window, door, stage, or bed. Furthermore, swags may exist singly or in multiples aligned along the partially covered structure.

While elegant and simple in appearance, swags are complex and can be very difficult to make, especially by inexperienced persons. Various methods have been proposed for educating persons in how to effectively and efficiently make swags. For example, instruction books are available which outline in text and drawings steps for making swags, but such instruction books are often very difficult for an inexperienced person to understand and the significant features of the drawings and text are often unappreciated. Consequently, attempts at forming swags by inexperienced persons with instruction books result in large amounts of wasted fabric and time.

Another method that has been developed in swag construction is the use of mechanical jigs. For example, a mechanical jig known as a "Swag Master" was once manufactured by OB/MASCO. This mechanical jig was very complex and consisted of a plurality of bowed, upstanding arcs aligned in a progressive, radially extending manner for placement of fabric around the arcs for gathering and cutting into a swag. Essentially, the swag was formed about the arcs and then cut to conform thereto. Such mechanical jigs have not been widely received in the industry because of their complexity, awkwardness in handling, and high manufacturing costs. Likewise, mechanical jigs have not been used by inexperienced persons for the same reasons.

Yet another method that has been developed—and perhaps the easiest before the present invention—includes the use of paper patterns. Fabric is placed flat on a surface and overlaid by a paper pattern corresponding to a desired swag body. The edges of the pattern are then traced to form the outline of the swag body. Moreover, the fabric can be folded about a center axis, wherein the pattern outlined will correspond to one-half of the swag body including one-half of the top and bottom of the swag body and a complete side thereof. Alternatively, the fabric can be laid flat without folding, wherein the pattern outlined will correspond to an entire swag body including the entire top, entire bottom, and complete sides of the swag body.

While paper patterns are typically easy to follow by inexperienced persons, only one size of swag and only one style of swag can be formed from any given paper pattern. Computer programs are available for printing patterns based on the desired size and style of swag. However, the printout of swag patterns requires a plotter because of its size, and plotters are very expensive and are often found only in engineering firms and very rarely in small or medium size businesses, let alone in the home. Furthermore, paper patterns, whether printed or purchased, are easily torn and ruined by inexperienced persons. Consequently, paper patterns have represented only a limited solution to facilitating swag construction by inexperienced persons.

There thus remains a need for a simple method and apparatus for making swags, even by inexperienced persons. Moreover, there remains a need for such a method and apparatus which will accommodate the making of both various sizes of swags and various styles of swags.

SUMMARY OF THE PRESENT INVENTION

Accordingly, it is an object of the present invention to provide a simple method and corresponding apparatus for making swags that can be efficiently and effectively used, even by inexperienced persons.

It is another object of the present invention to provide a simple method and corresponding apparatus that accommodates the making of various sizes and styles of swags.

It is yet another object of the present invention to improve upon the formation of the planar outline of swag bodies using paper patterns by presenting an easier and more versatile method and corresponding apparatus which is capable of forming the outline of swag bodies of various sizes and styles. Moreover, it is an object of the present invention to provide such a versatile apparatus that is more durable in nature than paper patterns.

The present invention includes the method of making an outline on a length of fabric of a swag body having a selected size and a selected style by using a first template for outlining top and bottom portions of the swag body and then using a second, separate template for further outlining a side portion of the swag body. The templates are preferably unadjustable and formed from sheets of durable plastic and include indicia thereon for forming traditional and cut-out swag bodies having various different swag dimensions of swag drop and swag width.

Briefly summarized, the present invention includes the method of outlining a swag body on fabric including: overlaying a first template over fabric; partially outlining a swag body on the fabric; removing the first template; overlaying a second template over the fabric; and further outlining the swag body on the fabric. Preferably, the first template is used to outline a top portion and a bottom portion of both traditional and cut-out swag bodies as well as an upper corner side portion of traditional swag bodies, and preferably the second template is used to outline a side portion of the swag body.

The method further preferably includes folding the fabric about a foldline and orienting the first template on the fabric with respect to a center axis of the swag whereby the foldline lies collinear with the center axis of the swag body.

The method further preferably includes marking a side edge reference line on the fabric with the first template and orienting the second template on the fabric with respect to the side edge reference line during the overlaying of the second template.

In a feature of the method, the outlining with the second template includes outlining triangular portions of the swag body, each triangular portion defining an area for forming a pleat, and the outlining further includes repeatedly positioning the second template along the side edge reference line in adjacent consecutive positions, a said triangular portion being outlined each time the second template is repositioned along the side edge reference line.

The method of the present invention also includes partially outlining on fabric two swag bodies by: overlaying an unadjustable template over a fabric and outlining a top portion and a bottom portion of a swag body having selected swag dimensions of swag drop and swag width; and overlaying the template over another fabric and outlining a top portion and a bottom portion of another swag body having different selected swag dimensions of swag drop and swag width.

The method of the present invention also includes partially outlining on fabric two swag bodies by: overlaying an unadjustable template over a fabric having a partial outline of a swag body of selected swag drop and swag width; outlining a side portion of the swag body with the overlaid template; overlaying the same template over another fabric having another partial outline of a swag body having a different selected swag drop and swag width; and outlining a side portion of the second swag body with the template.

The apparatus of the present invention includes a pair of templates used together for partially outlining a swag body on fabric. A first template of the pair includes indicia for outlining on fabric a top portion and a bottom portion of a swag body; and a second template includes indicia for outlining on the fabric only a side portion of the swag body that was outlined with the first template.

In a feature of the present invention, the indicia of the first template includes top demarcation lines printed on the first template for use in outlining a top portion of a plurality of traditional swag bodies. Each top demarcation line preferably corresponds to a different swag drop, and each top demarcation line preferably includes apertures corresponding to swag widths.

In another feature, the indicia on the first template includes bottom demarcation lines for use in outlining a bottom portion of a plurality of traditional and cut-out swag bodies. Preferably, each bottom demarcation line corresponds to a different swag drop, and each bottom demarcation line includes apertures corresponding to different swag widths.

In yet another feature of the present invention, the indicia on the first template include cut-out demarcation lines printed on the first template for use in outlining a top portion of a plurality of cut-out swag bodies. Preferably each cut-out demarcation line corresponds to a different swag drop.

In still yet another feature of the present invention, the first template further includes a tracing edge for use in tracing a reference line on the fabric and the indicia on the second template includes base lines for use in orienting the second template with respect to the reference line. Preferably each base line corresponds to a different swag drop for accommodating swag bodies of various swag drops. Furthermore, the second template preferably includes an angular side edge for outlining triangular portions defining the side edge of the swag body, and the second template preferably is dimensioned to form a predetermined number of triangular portions defining the side edge of the swag body.

The apparatus of the present invention further includes an unadjustable template including means for outlining a top portion and a bottom portion of a plurality of swag bodies of different swag dimensions when the template is overlaid fabric. Separate and apart therefrom, the apparatus of the present invention also includes an unadjustable template including means for outlining a side portion of a plurality of swag bodies of different swag dimensions when the template is overlaid fabric.

DETAILED DESCRIPTION OF THE PREFERRED EMBODIMENT

Figure 1:
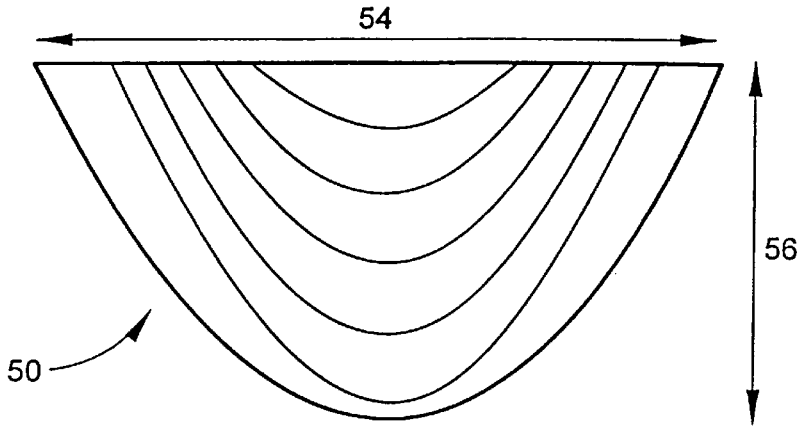
FIG. 1 is a front elevational view of a traditional swag.
Figure 2:
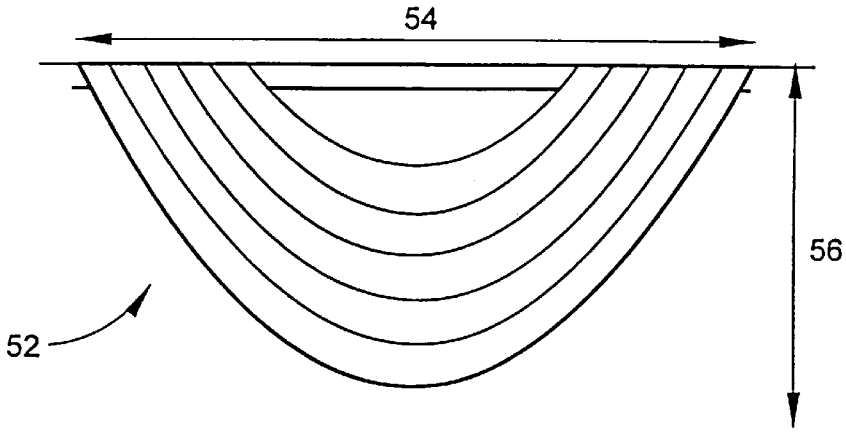
FIG. 2 is a front elevational view of a cut-out swag.

Turning now to the drawings, a pair of finished swags is shown in FIGS. 1 and 2 to illustrate the difference between a traditional style swag and a cut-out style swag. The swag 50 of FIG. 1 is a traditional swag characterized by a complete parabolic fabric face and the swag 52 of FIG. 2 is a cut-out swag characterized by a parabolic fabric face having an upper parabolic portion cut therefrom. While different in style, the two swags 50,52 have identical swag dimensions of swag width 54 and swag drop 56, and the choice between a traditional swag or a cut-out swag is merely a matter of design.

In accordance with an object of the present invention, the present invention is versatile enough to include the capability of forming either style of swag shown in FIGS. 1 and 2. Specifically, the method of making a swag in accordance with the present invention preferably includes the use of first and second templates for partially outlining one-half of a body of either a traditional swag or a cut-out swag on a planar surface of fabric to one side of a center axis (axis of reflection) of the swag body.

With regard to the first template, this template preferably is used to outline part of the swag body comprising one-half of the top of the swag body, substantially one-half of the bottom of the swag body, and an upper side corner of the swag body. The first template is also used to locate the center axis of the swag body so that by folding the fabric along the center axis and by cutting along the outline of the swag body drawn on the fabric with the first and second templates, a complete swag body will be made.

Figure 3:
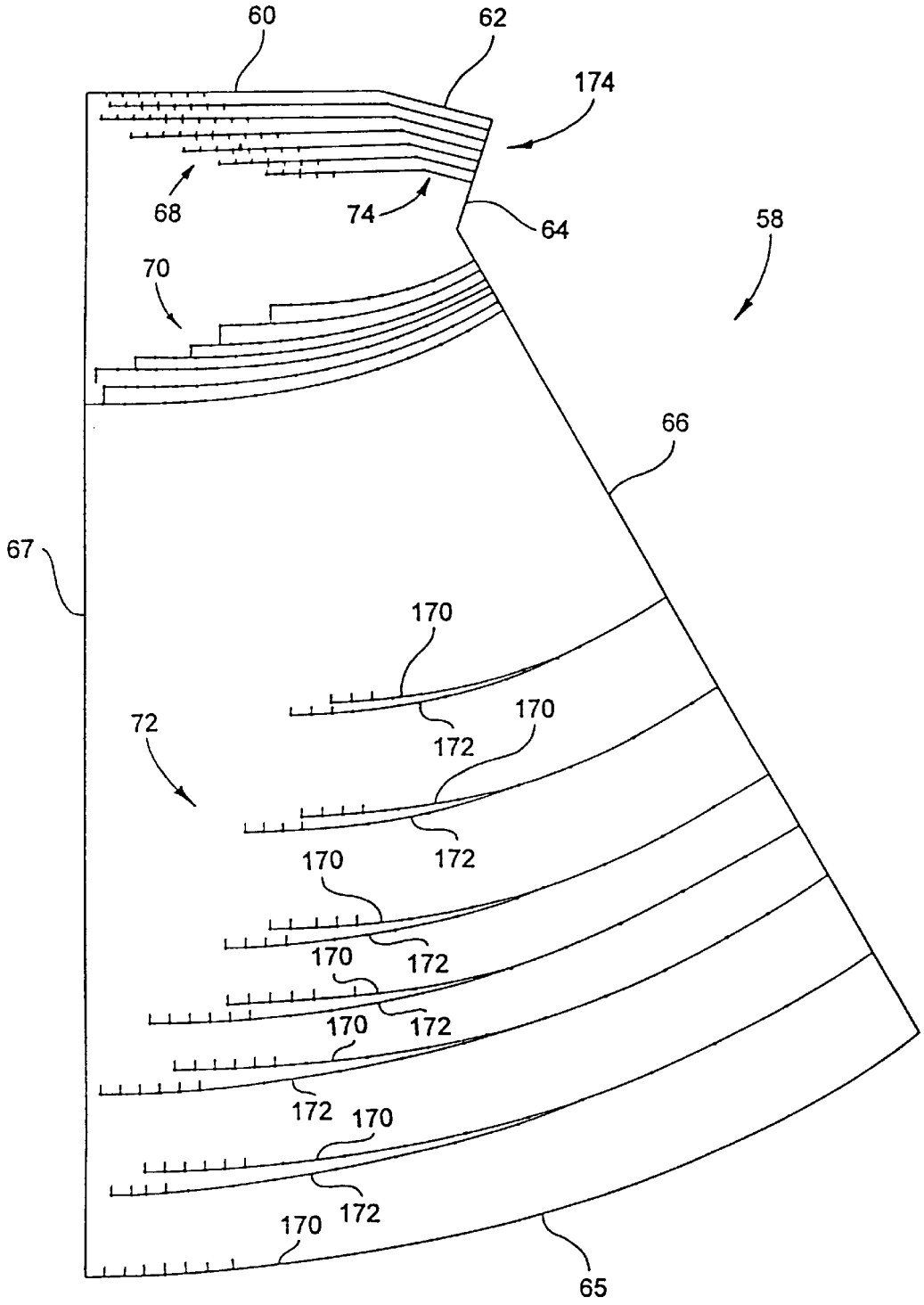
FIG. 3 is a top plan view of the preferred first template of the present invention.

The preferred first template 58 of the present invention, illustrated in FIG. 3, is preferably planar and constructed from a durable, resilient, and transparent sheet of plastic that can be rolled and conveniently stored. Furthermore, the template preferably is unadjustable. The template 58 includes a planar polygonal body preferably having a top linear edge 60, first and second linear side edges 62,64 of identical length, a tracing edge 66, a curved bottom edge 65, and a third linear side edge 67.

The first template 58 further includes a plurality of indicia thereon. In particular, the template 58 preferably includes: a plurality of linear top demarcation lines 68; a plurality of curved cut-out demarcation lines 70; a plurality of curved bottom demarcation lines 72; and a plurality of linear corner demarcation lines 74.

Figure 7:
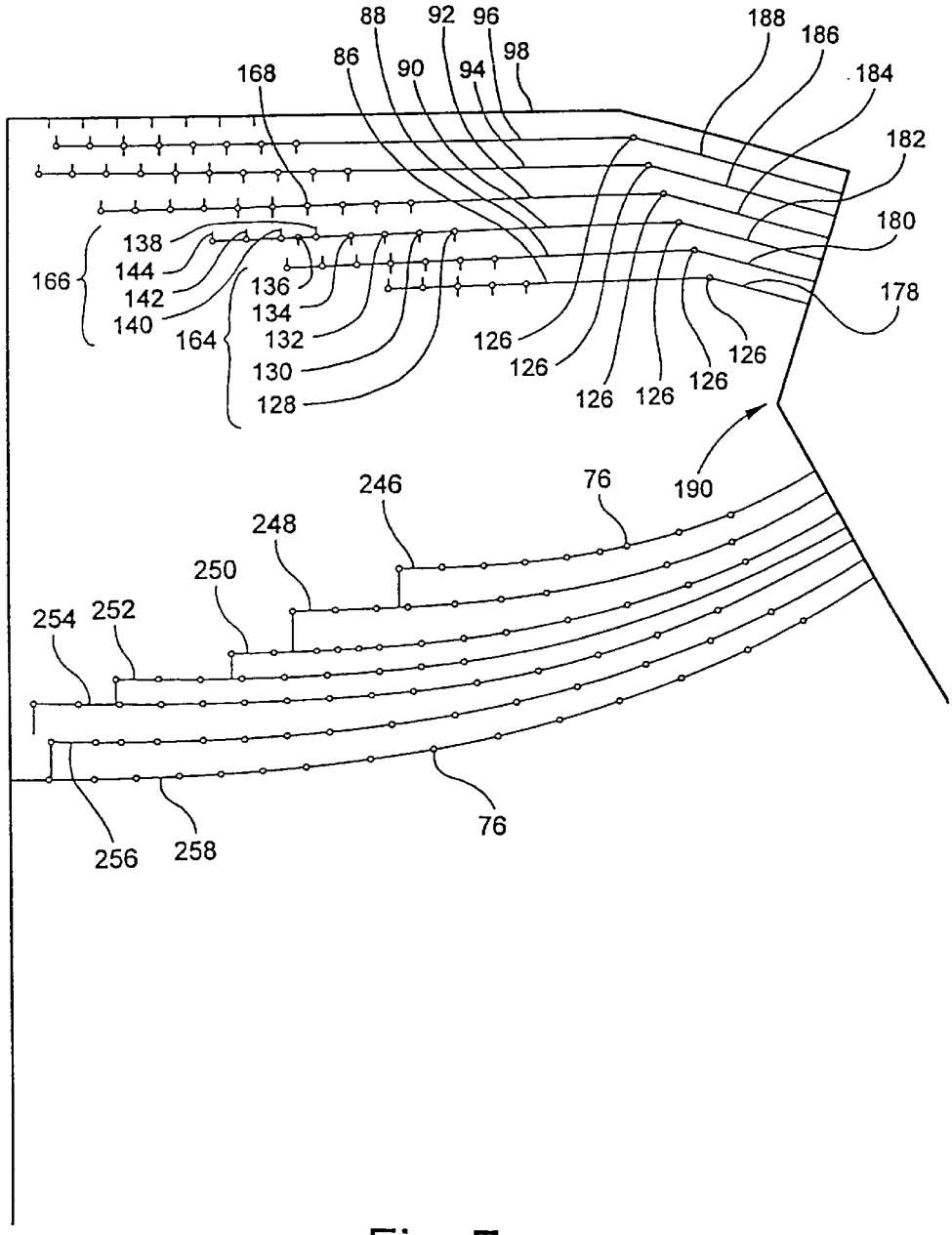
FIG. 7 is a top plan view in section of the top of the template of FIG. 3.

Each of the demarcation lines 68,70,72 preferably includes apertures 76 (shown in FIGS. 7 and 8) disposed therealong for use in outlining the swag body. Specifically, by extending a marker or pen through each aperture 76 disposed along a particular demarcation line 68,70,72, markings will appear on an underlying fabric which, when connected, will form a line on the underlying fabric corresponding to the particular demarcation line 68,70,72 on the template 58. Furthermore, by increasing the number of apertures 76 disposed along the particular demarcation line 68,70,72, the corresponding line formed on the fabric will have a greater resolution. Alternatively, a relatively small number of markings made on the fabric and consecutively connected together by line segments will form an approximate line corresponding to the particular demarcation line 68,70,72 on the template 58. Preferably, at least two apertures 76 are formed in every top demarcation line 68 and at least seven apertures 76 are formed in every cut-out demarcation line 70 and in every bottom demarcation line 72. Apertures 76 are not required along the corner demarcation lines 74 as will become apparent below.

The second template is used in the preferred method of the present invention in conjunction with the first template in order to finish outlining the one-half of the swag body on the fabric. In particular, the second template is used to complete the outline of the side of the swag body extending from the upper side corner to the bottom of the swag body.

Figure 4:
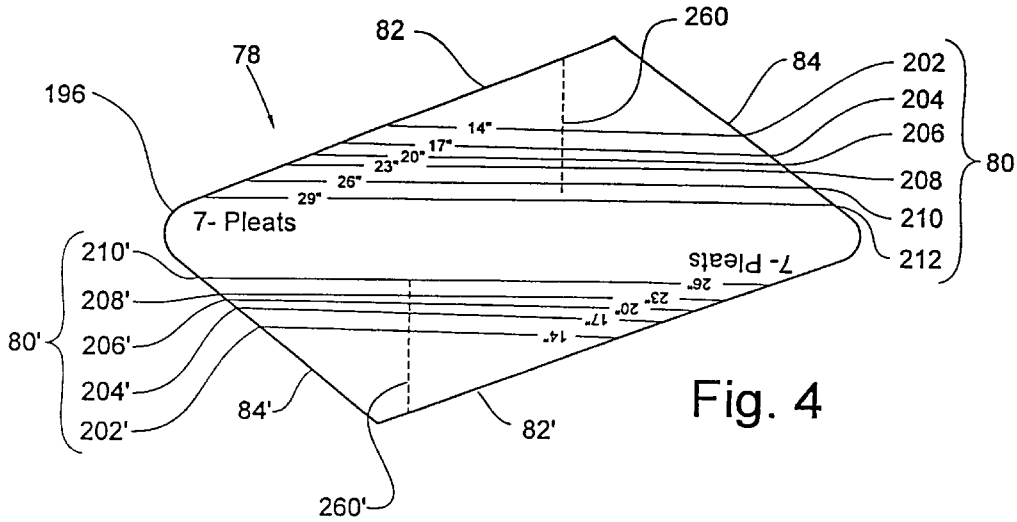
FIG. 4 is a top plan view of a preferred second template of the present invention used for making a swag with seven pleats.
Figure 5:
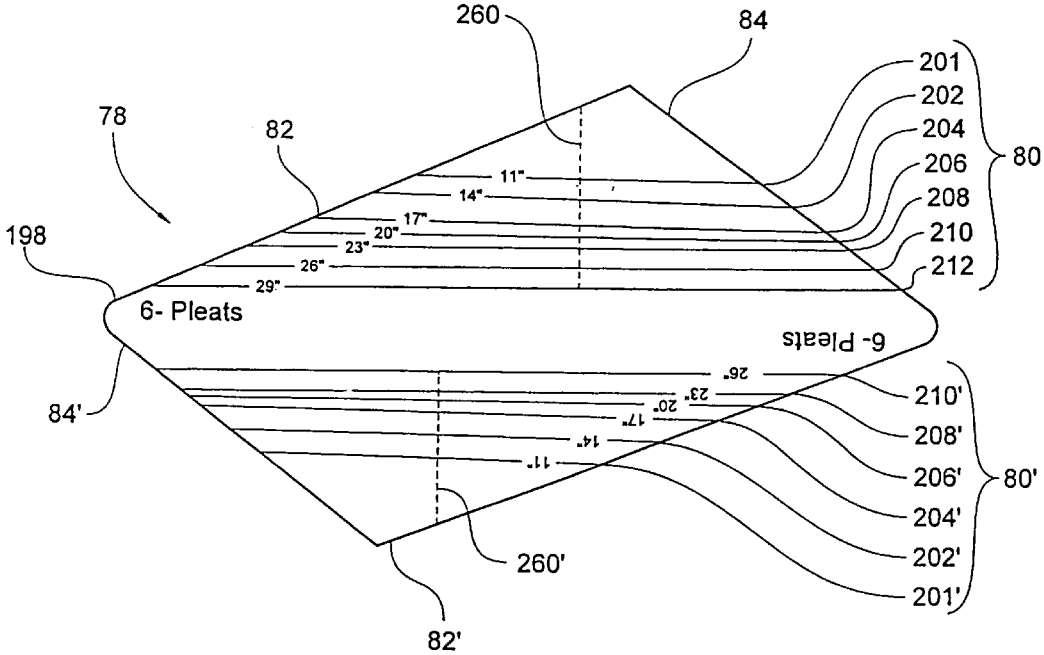
FIG. 5 is a top plan view of another preferred second template of the present invention used for making a traditional swag with six pleats or a swag-cut out with five pleats.
Figure 6:
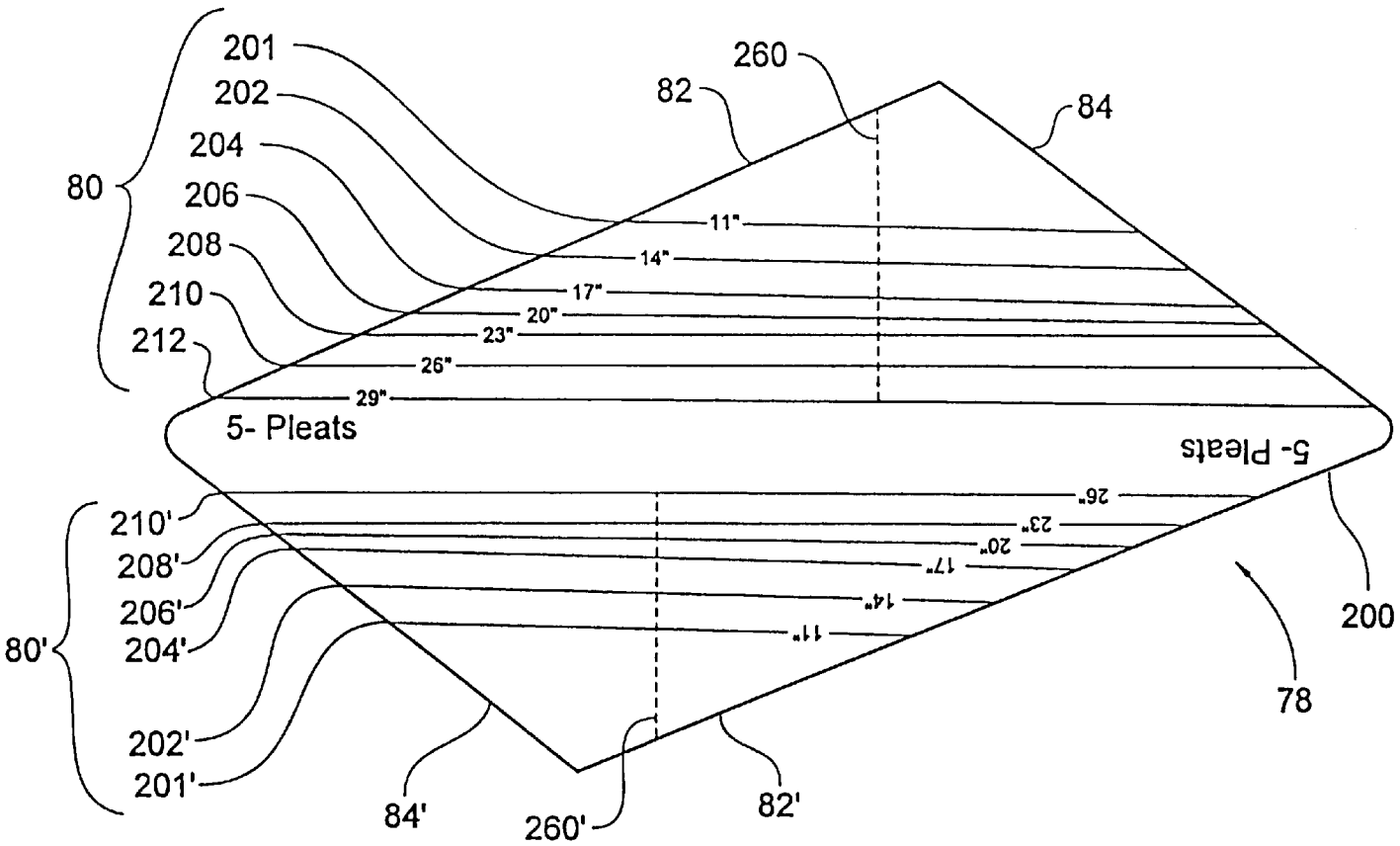
FIG. 6 is a top plan view of yet another preferred second template of the present invention used for making a swag with five pleats.

The preferred second template 78, three of which are illustrated in FIGS. 4–6, is preferably four-sided. However, it is only necessary that the second template of the present invention include two intersecting linear edges for partial demarcation of triangular portions which will preferably form the side of the swag body and, as will become apparent to one skilled in the art, the preferred four-sided template is formed by joining the base of two such triangular templates together.

Like the first template 58, the preferred second template 78 is also planar, transparent, and formed from a durable sheet of plastic. Furthermore, the second template preferably is unadjustable.

The second template 78 includes a plurality of indicia thereon. In particular, the template 78 includes a first triangular half having a plurality of linear base lines 80 which extend between a first edge 82 and a second edge 84 with the edges 82,84 intersecting one another at a common point to form with each base line 80 a triangle. The other triangular half includes the same type of indicia with reference numerals thereto in the Figures being the same with the exception of being primed.

As persons skilled in the art will recognize, various locations are possible for the placement of the indicia on the templates, e.g., the top demarcation lines, cut-out demarcation lines, bottom demarcation lines, corner demarcation lines, apertures, and base lines. These locations can be determined without undue experimentation by one having ordinary skill in the art. Moreover, the particular location of such indicia can vary from one design method to another for constructing the templates without departing from the scope of the present invention. For example, the locations can be obtained by overlaying a desired swag body over a transparent plastic sheet and tracing outlines of the swag body onto the template to form the demarcation lines, and so forth. Alternatively, the location of the demarcation lines can be mathematically calculated based on the desired swag dimensions after making various assumptions such as considering a swag to form a parabolic shape when hung. The present invention accordingly is not to be limited by these and any other methodologies for locating the indicia on the templates. While the templates and the indicia thereon comprise essential features of the invention, the various methodologies by which location of the indicia may be determined is not critical.

Having thus briefly described the two preferred templates of the present invention, further features of the preferred templates in relation to their use, as well as the preferred method of the present invention, will now be described in detail.

Initially, the dimensions of the swag and the style of the swag must be determined in accordance with one's preference. For purposes of illustrating the preferred method of the present invention, the formation of a traditional swag having a swag drop of 17" and a swag width of 28" will be described hereinafter, it being understood that other combinations of swag widths and swag drops could likewise be used. Following the description of the formation of this traditional swag, the formation of a cut-out swag having the identical swag dimensions of swag width and swag drop will also be described.

Traditional Swag Having 17" Swag Drop and 28" Swag Width

Having chosen a fabric having a particular width and having selected the desired swag drop and swag width, a length of the fabric is unrolled and cut, the length being sufficient to carry out the swag construction set forth below. In particular, the length of fabric will be sufficient when the fabric will be capable of receiving an entire outline of the swag body to be shaped and hung to form the finished swag.

The First Template

Once the length of fabric has been cut, the fabric is preferably once folded to form a two-ply fabric layer. However, the fabric need not be folded before outlining one-half of the swag body and, instead, can be outlined before folding about the center axis, an object of the present invention being only to outline part of (and preferably a mirror half of) the swag body on fabric. Nevertheless, to insure that sufficient fabric is present to cut a full swag body from the fabric, it is preferred that the fabric first be folded to form a two-ply fabric layer whereby one can place the first template over the fabric and visually verify that the outline of the swag body about to be made will be entirely encompassed by the two-ply fabric layer for later cutting.

If the fabric is folded first, then the first template must be properly oriented to the fabric by aligning indicia on the template corresponding to the desired swag drop of 17" to the fabric foldline. In particular, with reference to FIG. 7 each one of the plurality of top demarcation lines 68 preferably corresponds to a desired swag drop and the first template preferably includes seven demarcation lines 86,88, 90,92,94,96,98, with demarcation line 86 corresponding to a swag drop of 11"; demarcation line 88 corresponding to a swag drop of 14"; demarcation line 90 corresponding to a swag drop of 17"; demarcation line 92 corresponding to a swag drop of 20"; demarcation line 94 corresponding to a swag drop of 23"; demarcation line 96 corresponding to a swag drop of 26"; and demarcation line 98 corresponding to a swag drop of 29".

Figure 8:
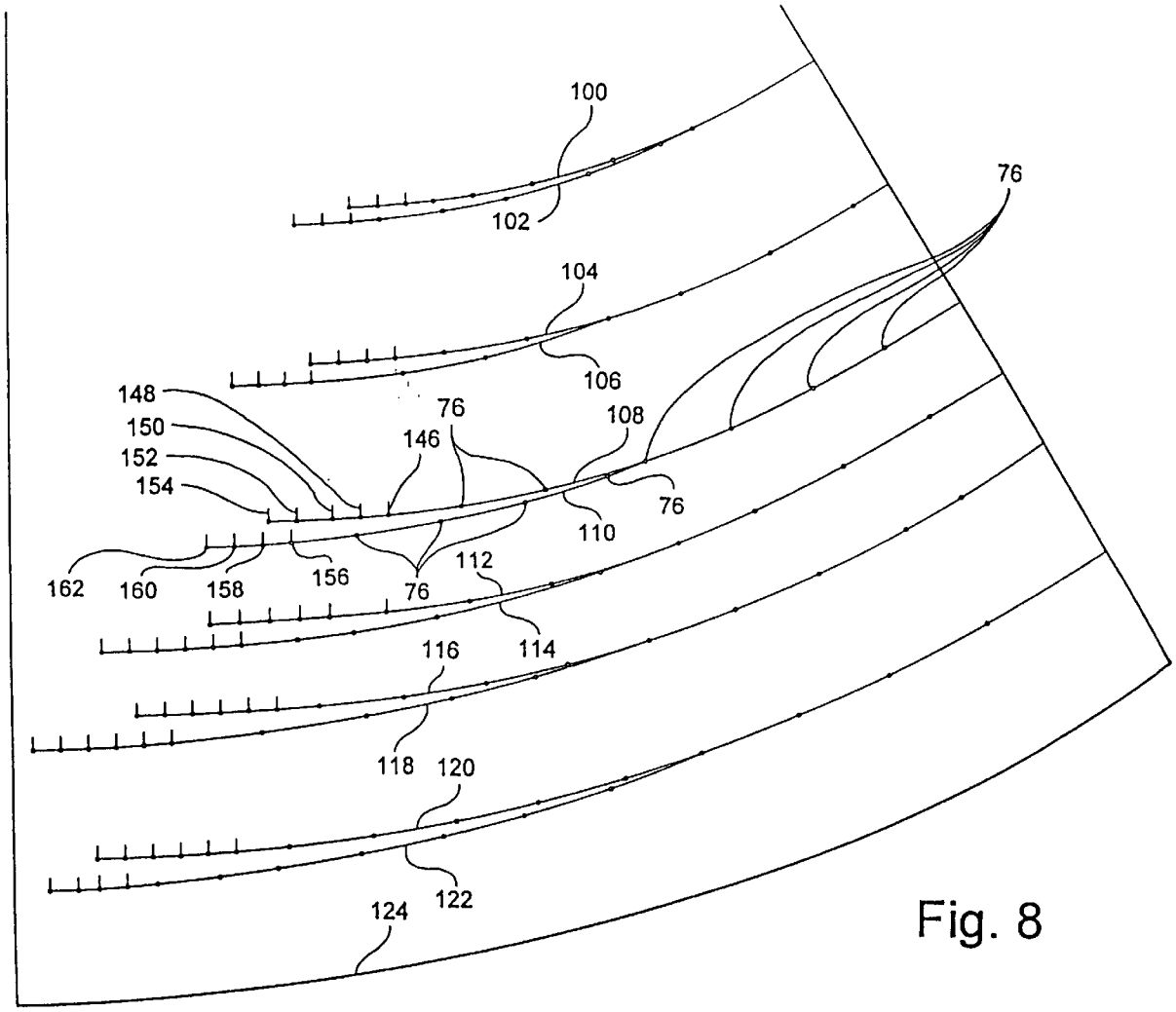
FIG. 8 is a top plan view in section of the bottom of the template of FIG. 3.

Likewise, with regard to FIG. 8 the same seven swag drops are represented by the bottom demarcation lines 72 on the first template 58, namely: bottom demarcation lines 100,102 corresponding to a swag drop of 11"; bottom demarcation lines 104,106 corresponding to a swag drop of 14"; bottom demarcation lines 108,110 corresponding to a swag drop of 17"; bottom demarcation lines 112,114 corresponding to a swag drop of 20"; bottom demarcation lines 116,118 corresponding to a swag drop of 23"; bottom demarcation lines 120,122 corresponding to a swag drop of 26"; and bottom demarcation line 124 corresponding to a swag drop of 29".

Additionally, in order to reduce manufacturing costs and improve efficiency, top demarcation line 98 and bottom demarcation line 124 each corresponding to a swag drop of 29" are not drawn or otherwise printed on the template 58, but instead, are coincident with the top linear edge 60 and the curved bottom edge 65 of the template 58.

Each one of the top and bottom demarcation lines 68,72 (excluding top demarcation line 98 and bottom demarcation line 124) includes apertures 76 formed in the template 58 for extending a marker therethrough for marking on the underlying fabric, and an aperture 76 along a particular demarcation line 68,72 preferably corresponds with a desired swag width for the swag drop corresponding to that respective demarcation line 68,72 along which it is disposed. Additionally, an aperture 126 is also disposed at the end of each top demarcation line 68 which serves to identify the end of the top of the swag body.

With particular regard again to FIG. 7, apertures 76 disposed along the demarcation line 90, which line corresponds to a swag drop of 17", includes apertures 128,130, 132,134,136,138,140,142,144 which correspond to swag widths of 28", 30", 32", 34", 36", 38", 40", 42", and 44", respectively. Likewise, with regard again to FIG. 8, some apertures 76 disposed along these lines also serve to indicate swag width. Thus, apertures 76 disposed along demarcation lines 108,110, which lines correspond to a swag drop of 17", includes apertures 146,148,150,152,154,156,158,160,162 which correspond to swag widths of 28", 30", 32", 34", 36", 38", 40", 42", and 44", respectively.

Furthermore, it should be noted that correspondence of apertures 76 to swag widths disposed along top demarcation lines 68 are not necessarily arranged in continuous sequential order. Instead, preferably two sequences 164,166 of increasing swag widths are disposed along top demarcation lines 68 in partial overlap and are distinguished from one another by color, a first sequence 164 being printed in black and a second sequence 166 being printed in red. Thus, for example, the first sequence 164 of apertures 128,130,132, 134,136 corresponding to swag widths of 28", 30", 32", 34", and 36", disposed along top demarcation line 90 corresponding to a swag drop of 17", are preferably in black; and the second sequence 166 of apertures 138,140,142,144, corresponding to swag widths of 38", 40", 42", and 44", disposed along the same top demarcation line 90, are preferably in red, with aperture 138 being disposed between aperture 134 and aperture 136. Moreover, one particular aperture can correspond to two different swag widths, such as aperture 168 preferably corresponding to swag widths of 38" and 42" disposed on top demarcation line 92 corresponding to a swag drop of 20".

As a result of this overlap, each one of a first plurality 170 of bottom demarcation lines 72 on the first template preferably correspond to the first sequence 164 of swag widths on each corresponding top demarcation line 68, and each one of a second plurality 172 of bottom demarcation lines 72 preferably correspond to the second sequence 166 of swag widths on each corresponding top demarcation line 68. Furthermore, each one of the first plurality 170 of the bottom demarcation lines 72 corresponding to a particular swag drop is preferably partially coextensive in extending away from the tracing edge 66 with each one of the second plurality 172 of the bottom demarcation lines 72 corresponding to the same swag drop. Each extent of each one of the second plurality 172 of the bottom demarcation lines 72 not coextensive with one of the first plurality 170 of demarcation lines 72 is preferably printed in red with the other coextensive extent thereof printed in black, and each one of the first plurality 170 of demarcation lines 72 is preferably printed in black. A swag width printed in black or red in a top demarcation line 68 corresponding to a particular swag drop thereby preferably indicates reference to a corresponding swag width printed in black or red, respectively, in the corresponding bottom demarcation lines 72 for the same swag drop.

Figure 9:
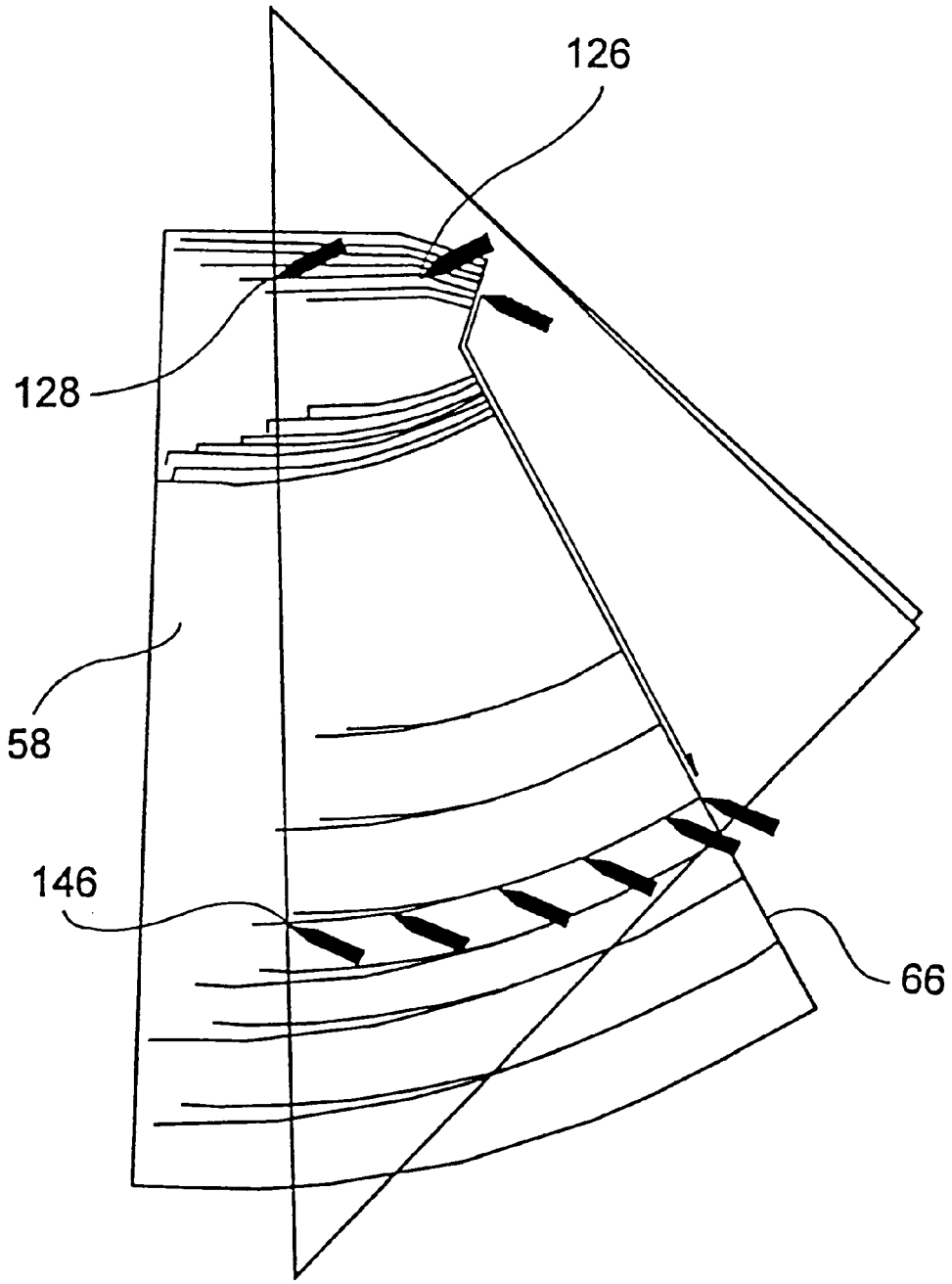
FIG. 9 is a top plan view of the template of FIG. 3 on top of a folded length of fabric.

As set forth above, if the fabric is first folded then the first template 58 must be properly oriented. To accomplish the proper orientation, the apertures 76 corresponding to the chosen swag width disposed along the demarcation lines 68,72 corresponding to the chosen swag drop must be aligned over a fabric foldline as shown in FIG. 9. Thus, in the present example, since the chosen swag drop is 17" and chosen swag width is 28", specific reference is had to the top demarcation line 90 and bottom demarcation lines 108,110 corresponding to a swag drop of 17". Aperture 128 disposed along top demarcation line 90 and aperture 146 disposed along bottom demarcation line 108 correspond to a swag width of 28" and each is printed in black and, thus, the first template 58 is positioned on the folded fabric whereby the foldline intersects each aperture 128,146. When the foldline intersects both apertures corresponding to the desired swag drop and swag width as shown in FIG. 9, then the template is properly oriented with respect to the folded fabric and the outlining of one-half of the swag body can commence.

If the fabric is not folded, the apertures 128,146 corresponding to the selected swag drop and swag width are still referenced but, instead of aligning a foldline to intersect both apertures, a marker is used to mark the underlying fabric through the two apertures and, when the template is removed, the two markings lie along and thereby define the center axis of the swag body for later folding and then cutting of the fabric.

Demarcating the Top, Bottom, and Upper Side Corner of the Swag Body

Having properly oriented the first template to the fabric with reference to the center axis, the top half, substantially all of the bottom half, and the upper side corner of the swag body are ready for outlining with the first template.

To outline one-half of the top and substantially all of one-half of the bottom of the swag body on the fabric surface, the fabric is marked through aperture 128 corresponding to the chosen swag width and through aperture 126 corresponding to the end of the demarcation line 90 as shown in FIG. 9, and the fabric is marked through every aperture 76 disposed on the bottom demarcation line 108 between and including aperture 146 and the tracing edge 66 of the template also as shown in FIG. 9. When the template 58 is removed from the fabric, these marking along the top and bottom of the swag body are connected together as shown by dotted lines on the folded fabric in FIG. 10.

In order to outline an upper side corner of the swag body, a triangular corner portion 174 of the template 58 formed by the first and second linear side edges 62,64 is used. Specifically, the triangular corner portion 174 of the template 58 serves to at least partially outline a triangular upper side corner 176 of the side edge of the swag body, with the size of the upper side corner 176 depending upon the selected swag drop.

In particular, the first side edge 62 and the second side edge 64, i.e., triangular corner portion 174 of the first template 58 itself, demarcate a triangular upper side corner of the side edge of a swag body for a swag having a 29" swag drop, and other indicia demarcating the triangular edges for swags having swag drops less than 29" are provided on the first template 58. The other indicia include corner demarcation lines 178,180,182,184,186,188 for swags having swag drops of 11", 14", 17", 20", 23", and 26", respectively. Moreover, each corner demarcation line 74 extends linearly from ending apertures 126 of each corresponding top demarcation lines 68 to intersect the second side edge 64 of the template 58, with the distance between the intersection of each corner demarcation line 74 and the second side edge 64 to an end 190 of the second side edge 64 being identical to the length of the respective corner demarcation line 74. Hence, each corner demarcation line 74 represents a leg of an isosceles triangle.

Figure 10:
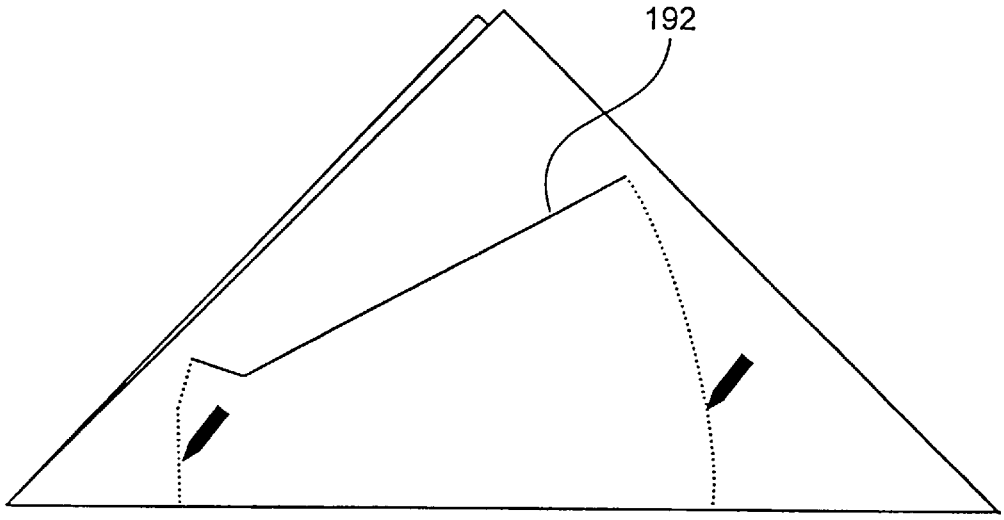
FIG. 10 is a top plan view of the folded length of fabric of FIG. 9 with markings and outlines made using the template of FIG. 3.

The outline of the upper side corner of the swag body is thus formed by: tracing along the second side edge 64 of the template 58 from the end 190 of the second side edge 64 intersecting the tracing edge 66 toward the first side edge 62 but only to the point of intersection with the appropriate corner demarcation line 182 corresponding to the chosen swag drop of 17" as shown in FIG. 9; and, when the first template is removed, drawing a line segment along where the corner demarcation line 182 was, i.e., between the end of the tracing along the second side edge 64 and the marking made through the aperture 126 identifying the end of the top demarcation line 90 corresponding to the selected swag drop of 17" also as shown by dotted line in FIG. 10.

Defining a Side Edge Reference Line

Finally, while the template is in its proper orientation with regard to the fabric, a side edge reference line 192 is defined by tracing along the entire tracing edge 66 of the template 58 as shown by the arrow in FIG. 9. Thus, the side edge reference line 192 extends from the bottom demarcation line 124 to the end 190 of the second side edge 64. Furthermore, the tracing edge 66 of the template 58 is preferably collinear with the apertures 126 identifying the ends of demarcation lines 68. As will become apparent, the side edge reference line 192 is not an outline of the side of the swag body, but rather, this line 192 serves as a reference line for proper positioning of the second template with respect to the fabric for outlining the rest of the side of the swag body not outlined with the first template, discussed next.

The Second Template

Figure 11:
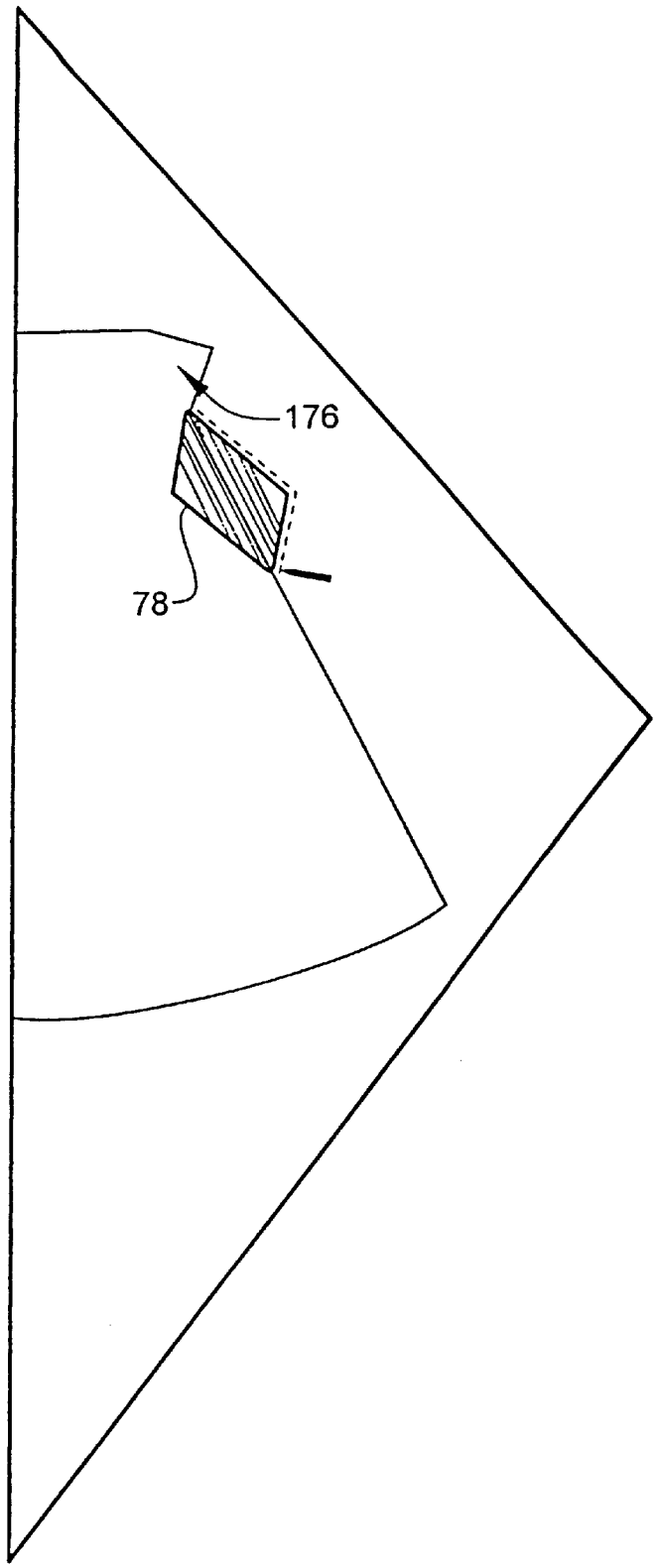
FIG. 11 is a top plan view of the template of FIG. 6 properly oriented on top of the folded fabric of FIG. 9.
Figure 12:
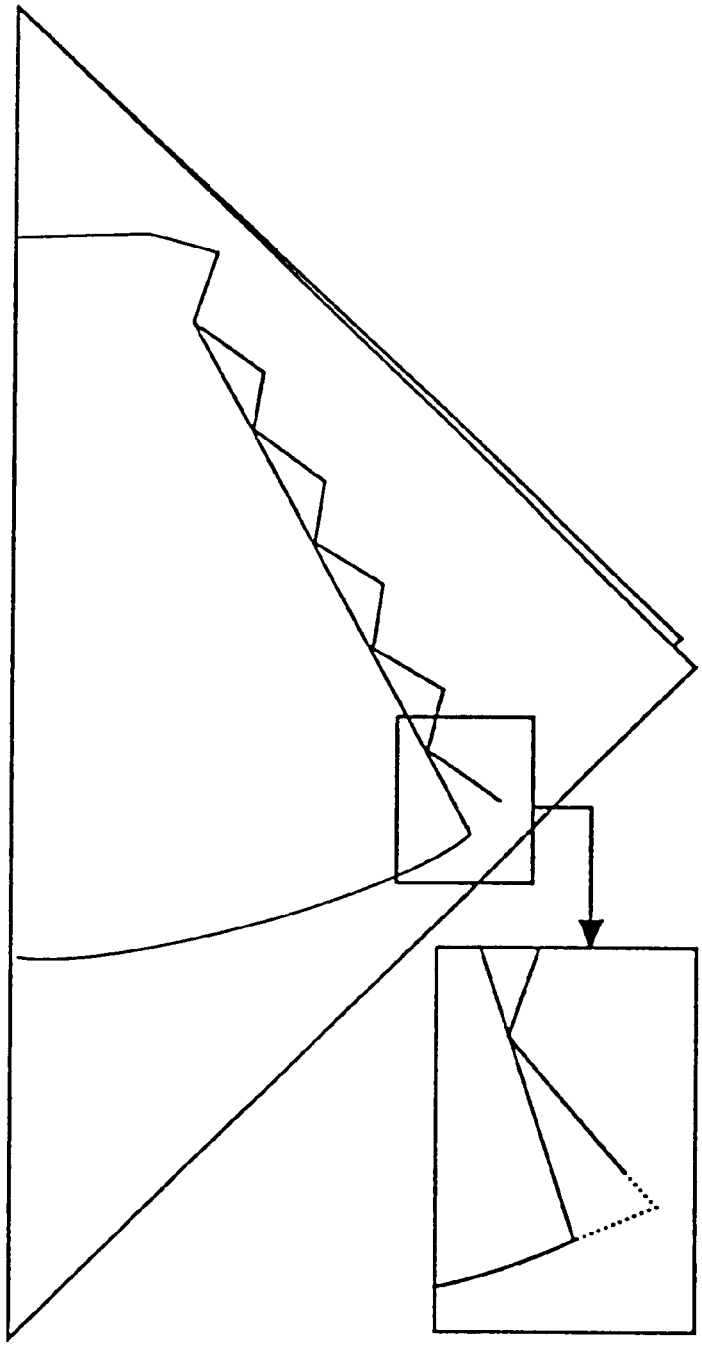
FIG. 12 is a top plan view of the folded fabric of FIG. 10 with further outlines made using the template of FIG. 6.

Once the top, bottom, and upper side corner 176 of the swag body have been outlined as discussed above, the first template 58 is removed from the fabric and the second template 78 is overlaid the fabric in order to finish outlining the side edge of the swag body between the upper side corner 176 and the bottom of the swag body. Specifically, further triangular portions 194 preferably are formed extending in continuous manner from the side edge reference line 192 between the isosceles triangular side corner 176 of the swag body and the bottom of the swag body by tracing along the two intersecting edges 82,84 of the second template 78 as shown in FIGS. 11 and 12. Moreover, the second template 78 must be consecutively repositioned on the fabric along the side edge reference line 192 in outlining the further triangular portions 194 of the side edge of the swag body, a triangular portion 194 being outlined each time the second template 78 is repositioned.

As discussed above, the second template 78 includes indicia in the form of base lines 80,80' corresponding to the various swag drops, the base lines 80,80' serving to properly orient the second template 78 in relation to the partial swag body outlined using the first template 58. Furthermore, since the second template 78 is used for forming triangular portions 194 defining the edge of the swag body, each triangular portion 194 later being folded to form a pleat of the swag, the size of the triangular portions 194 determines the number of pleats the swag being formed will have. Thus, the second template 78 can be formed with various sizes, three of which are shown in FIGS. 4, 5, and 6.

Specifically, three four-sided templates 196,198,200 shown in FIGS. 4–6 are used for forming seven, six, and five pleats in traditional swags, respectively, and six, five, and four pleats in cut-out swags, respectively. As shown in FIG. 6 for example, the second template 78 includes base lines 201,202,204,206,208,210,212 corresponding to swag drops of 11", 14", 17", 20", 23", 26", and 29", respectively. Furthermore, as previously mentioned, each of the triangular halves of the second template 196,198,200 is formed from the joining of the bases of two triangles, with each triangular half differing from the other half of each template 196,198, 200 in the number, spacing, and positioning of the base lines 80 compared with base lines 80', with one triangular half being used with the first sequence 164 of apertures 76 and first plurality 170 of bottom demarcation lines 72, and the other triangular half being used with the second sequence 166 of apertures 76 and second plurality 172 of bottom demarcation lines 72. Consequently, the indicia on the triangular half to be used in conjunction with the second plurality 172 of bottom demarcation lines 72 is preferably printed in red on the second template 78 (for which reference numbers include a prime), and the indicia printed on the other half of the second template to be used in conjunction with the first plurality 170 of bottom demarcation lines 72 preferably is printed in black (corresponding reference numbers without the prime).

In the present example of forming a traditional swag, if five pleats are desired then template 200 is used and base line 204 printed in black corresponding to a swag drop of 17" is chosen. (Likewise, base line 204 printed in black on template 198 is chosen if six pleats are desired, and base line 204 printed in black on template 196 is chosen if seven pleats are desired.) If the second sequence 166 of apertures 76 and second plurality 170 of bottom demarcation lines 72 had been referenced above, then base line 204' of the appropriate template 196,198,200 would have been used instead.

To outline the rest of the side edge of the swag body, the appropriate base line 204 of second template 200, which linearly extends from edge 82 to edge 84 on the second template 200, is superimposed over the side edge reference line 192 to extend parallel therewith, whereby the base line 204 begins at the end of the second side edge 190 and extends along the side edge reference line 192 toward the bottom of the swag body as shown in FIG. 11. Furthermore, in this orientation the intersection of the side edges 82,84 extends away from the fabric foldline. The triangular portion 194 of the side edge is then outlined by tracing the portion of the side edges 82,84 of the second template 78 extending from the side edge reference line 192 away from the center axis of the swag body, the triangular portion 194 thereby being formed continuous with the outline of the upper side corner 176 of the swag body.

To form the next triangular portion 194 of the side of the swag body, the second template 78 is then repositioned to a location adjacent the previous triangular portion 194, whereby an outline of another triangular portion 194 will be formed continuous with the outline of the previous triangular portion 194. This process is repeated along the side edge reference line 192 until the base line extends beyond the outline of the bottom of the swag body. At this point, the end of the outline of the bottom of the swag body is extended in continuous curved manner to the edge of the second template 78 to complete the outlining of the bottom one-half of the swag body as shown by dotted line in FIG. 12. Furthermore, the second template is preferably dimensioned so that the interpolation of the outline of the bottom of the swag body extends to the intersection of the edges 82,84 of the second template 78 when overlaid in the last position.

When the second template 78 has been so used, a side of the swag body will be completely outlined consisting of the outline of the upper side corner 176 and, continuous therewith, the outlines of continuous triangular portions 194 extending from the upper side corner 176 to the bottom of the swag body. Thus, after use of the second template 78, a complete outline of one-half of the desired swag body will have been formed on a length of folded fabric about a center axis thereof.

Cutting Out the Swag Body from the Fabric

Figure 13:
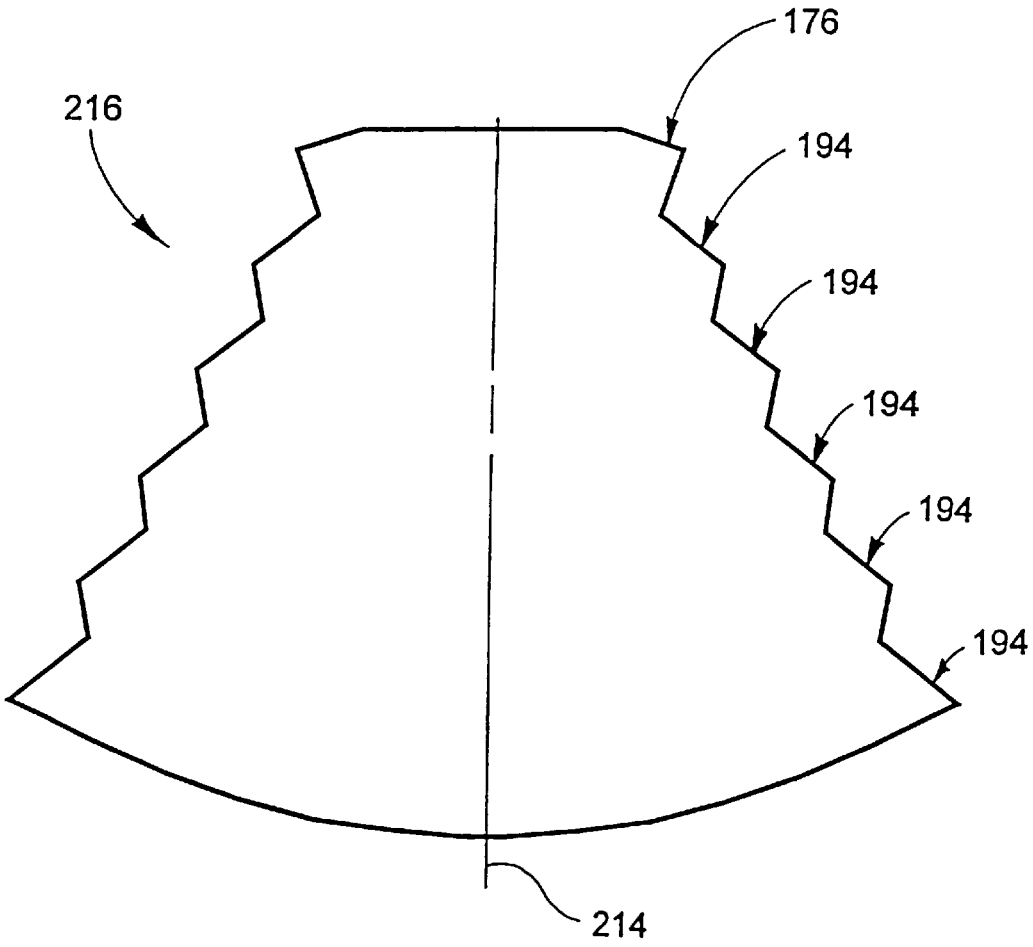
FIG. 13 is a top plan view of a swag body cut from folded fabric along the outlines of the folded fabric of FIG. 12.

To complete the making of the swag body, the fabric must be folded along the center axis 214 if it was not folded prior to the aforesaid outlining. Once folded, the two-ply fabric layer is cut along the outline of the one-half of the swag body made with the first and second templates, and the resulting cut fabric, when unfolded, will then yield the desired swag body 216 as shown in FIG. 13.

Folding and Hanging the Swag Body to Form the Finished Swag

To construct a fully-shaped swag from the swag body 216 having the desired swag dimensions, the swag body 216 is folded to form pleats and then hung. In particular, triangular portion 176 and each triangular portion 194 formed along the side edges of the swag body 216 are folded to form the pleats. If desired, a half inch seam can first be sewn in the bottom of the swag body.

Figure 14:
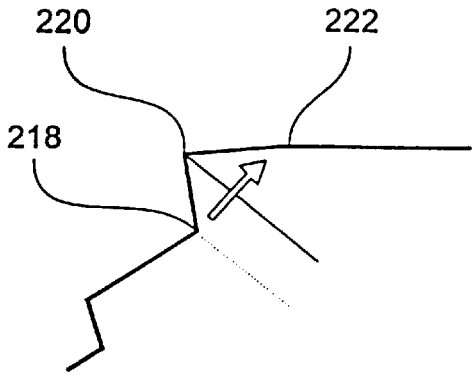
FIG. 14 is a perspective view of the beginning of the folding of a swag body to form a pleat.
Figure 15:
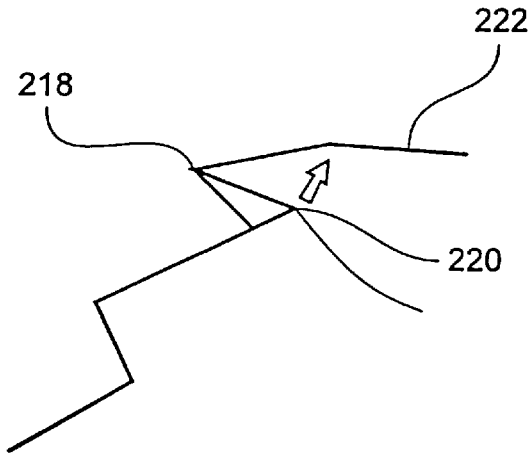
FIG. 15 is a perspective view of the continued folding of a swag body to form a pleat begun in FIG. 14.
Figure 16:
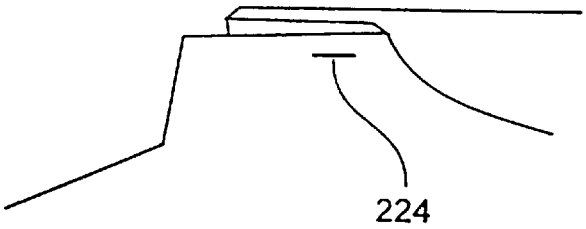
FIG. 16 is a perspective view of the finished fold begun in FIG. 14.
Figure 17:
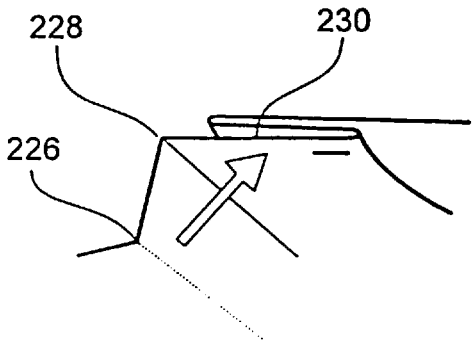
FIG. 17 is a perspective view of the beginning of the folding of a swag body to form a second pleat.
Figure 18:
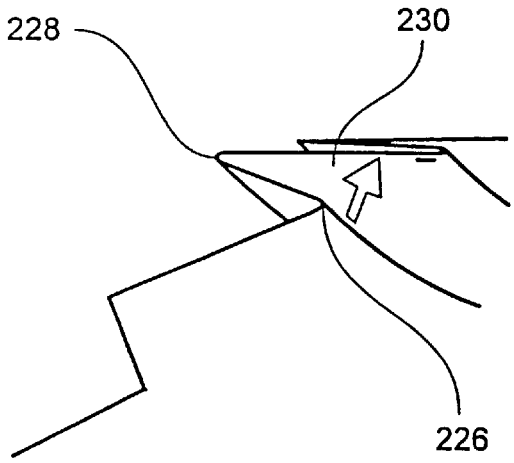
FIG. 18 is a perspective view of the continued folding of a swag body to form a second pleat begun in FIG. 17.
Figure 19:
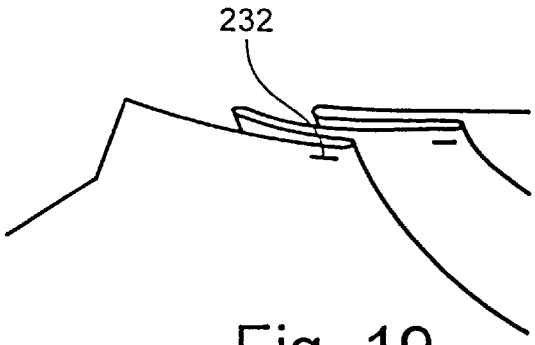
FIG. 19 is a perspective view of the finished fold begun in FIG. 17.

In forming the pleats of the swag, and with reference to FIGS. 14 and 15, a first fold is initiated wherein point 218 is advanced towards point 222 using foldline 220. Once the fold is completed, as seen in FIG. 16, it is stapled or pinned in place indicated at 224, the fold becoming the first pleat. Turning now to FIGS. 17, 18, and 19, the second pleat is formed with point 226 being advanced upwardly toward point 230 using foldline 228 and the fold is completed by stapling at 232. This process is repeated until the swag is complete with the desired number of pleats corresponding to the number of triangular portions 194 of the swag body 216.

Figure 20:
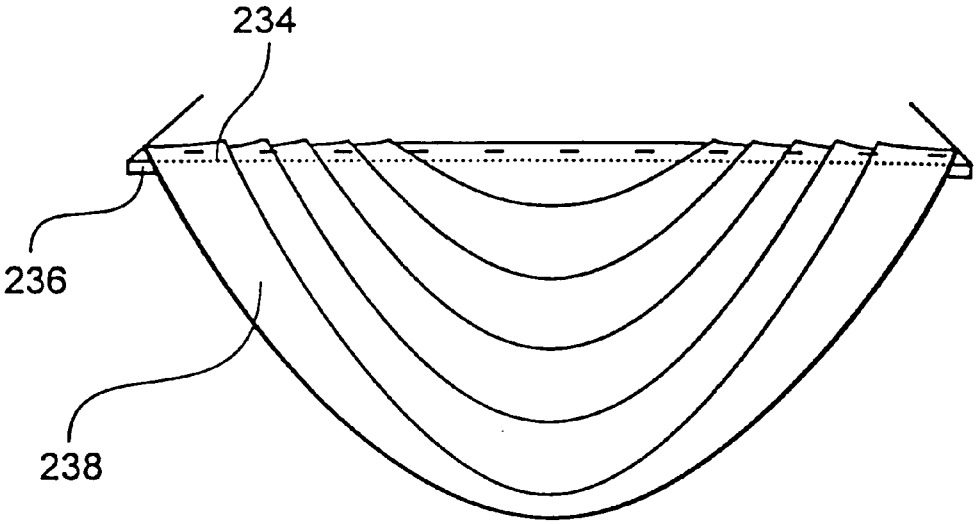
FIG. 20 is a perspective view of a traditional swag mounted to a mounting board.
Figure 21:
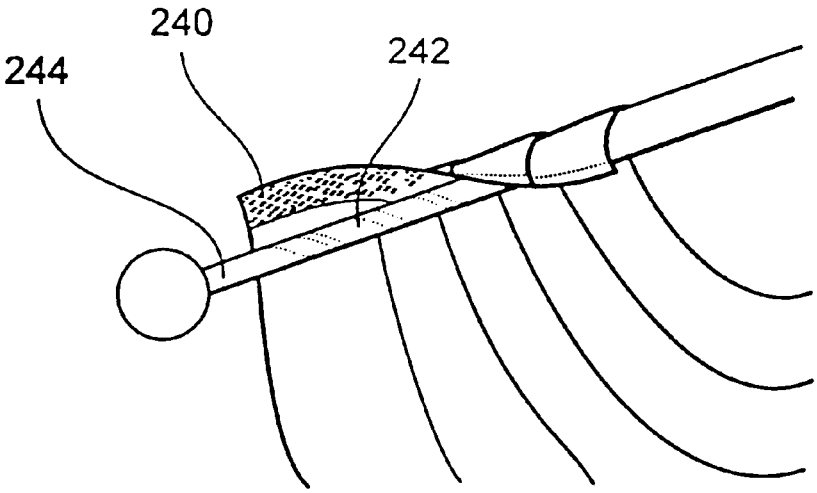
FIG. 21 is a partial perspective view of a traditional swag being mounted to a pole.

Once all the pleats are formed, a stitch 234 is provided across the top of the formed traditional swag 238 as shown in FIG. 20 for example to retain all the pleats in place. The swag 238 is then stapled to a mounting board 236 where the pleats are dressed into round folds as shown in FIG. 20. The top pleat is worked first and then pleat by pleat the pleats are dressed into round folds. Optionally, a strip of loop tape 240 may be attached to the back of the swag 238 and then attached to a pole 244 having been spirally wrapped with pressure sensitive hook tape 242 as shown in FIG. 21. The swag 238 may then be mounted for use, the desired traditional swag 238 with a swag drop of 17" and a swag width of 28" having been formed.

Cut-Out Swag Having 17" Swag Drop and 28" Swag Width

Having described the formation of a traditional swag having a swag drop of 17" and a swag width of 28", the formation of a cut-out swag having the same swag dimensions will be described in detail as will features of the preferred templates used in the preferred method for forming cut-out swags. The method of forming cut-out swags is the same as that for forming traditional swags with the exception of the following illustrative differences.

The first template is properly oriented to the fabric and the appropriate bottom demarcation line is used to outline the bottom one-half of the swag body as described with respect to forming the traditional swag body set forth above. However, because of the cut-out style swag including a parabolic upper portion removed from the finished swag, the cut-out demarcation lines 70 are used to outline the top one-half of the swag body instead of the top demarcation lines 68 used above for the traditional swag. Each cut-out demarcation line 70 is curved and extends from an intersection with the tracing edge 66 of the first template 58.

The first template 58 preferably includes seven cut-out demarcation lines 70 each corresponding to a particular swag drop. Thus, the cut-out demarcation lines 70 include cut-out demarcation line 246 corresponding to a swag drop of 11"; cut-out demarcation line 248 corresponding to a swag drop of 14"; cut-out demarcation line 250 corresponding to a swag drop of 17"; cut-out demarcation line 252 corresponding to a swag drop of 20"; cut-out demarcation line 254 corresponding to a swag drop of 23"; cutout demarcation line 256 corresponding to a swag drop of 26"; and cut-out demarcation line 258 corresponding to a swag drop of 29".

As previously mentioned, cut-out demarcation lines 70 also include apertures 76 and the outline of the top one-half of the swag body is formed by marking the underlying fabric through apertures 76 extending along demarcation line 250 between the tracing edge 66 and the center axis 214.

Figure 22:
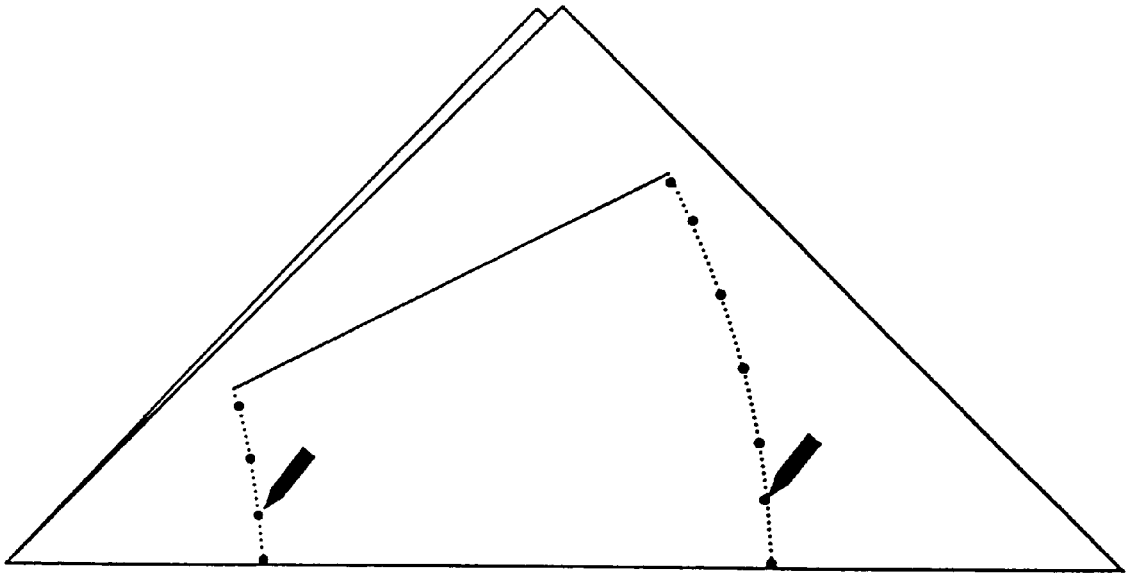
FIG. 22 is a top plan view of a folded fabric with markings and outlines made with the template of FIG. 3.

When the template 58 is removed, the markings are connected together to form the curved outline of the cut-out top portion of the swag body as shown in FIG. 22.

With respect to the side of the body of a cut-out swag, the upper triangular portion 174 of the template 58 is not used and the side edge reference line 192 is traced to extend from the bottom of the swag body only up to the intersection of the appropriate cut-out demarcation line 70 with the tracing edge 66 also as shown in FIG. 22.

Once one-half of the top and one-half of the bottom of the swag body have been properly outlined and the side edge reference line 192 has been marked, the first template 58 is removed and the preferred second template 78 of FIG. 5 is used to outline the entire side edge of the swag body. Furthermore, the use of the preferred second template 78 differs somewhat from the use described above in making the traditional swag, the difference arising because of the varying length of the side edge reference line 192 drawn in the cut-out swag process and the different orientation of the swag body itself when hung. Thus, the second template 78 preferably includes indicia for aligning the appropriate base lines 80,80' corresponding to the selected swag drop with the top curved outline of the swag body. In particular, the second template 78 preferably includes an alignment line 260,260' perpendicularly extending from the base lines 80,80' respectively as illustrated on the second template 198 for forming five pleats in FIG. 5. To properly orient this second template 200 to the fabric, the appropriate base line corresponding to the selected swag drop is superimposed on the side edge reference line 192 as discussed above with respect to the traditional swag but with the alignment line 260 positioned to extend from the intersection of the top curved outline of the swag body with the side edge reference line 192 as shown in FIG. 23.

Figure 23:
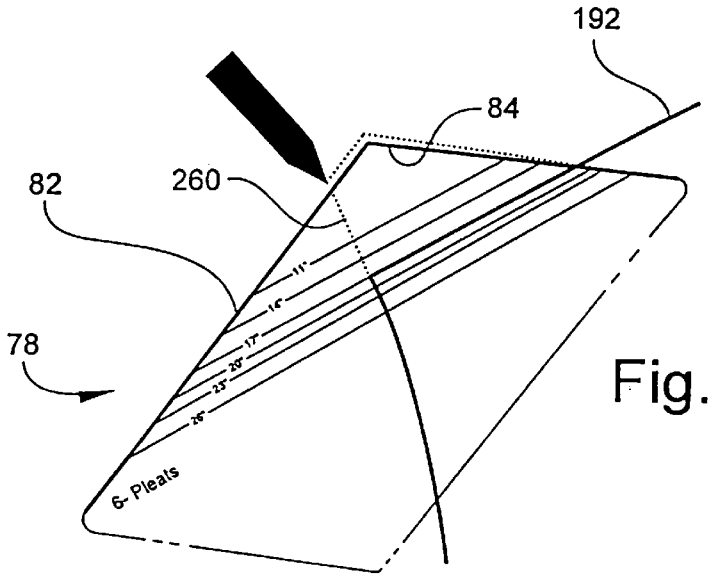
FIG. 23 is a top plan view in section of the template of FIG. 6 properly oriented on top of the folded fabric of FIG. 22.
Figure 24:
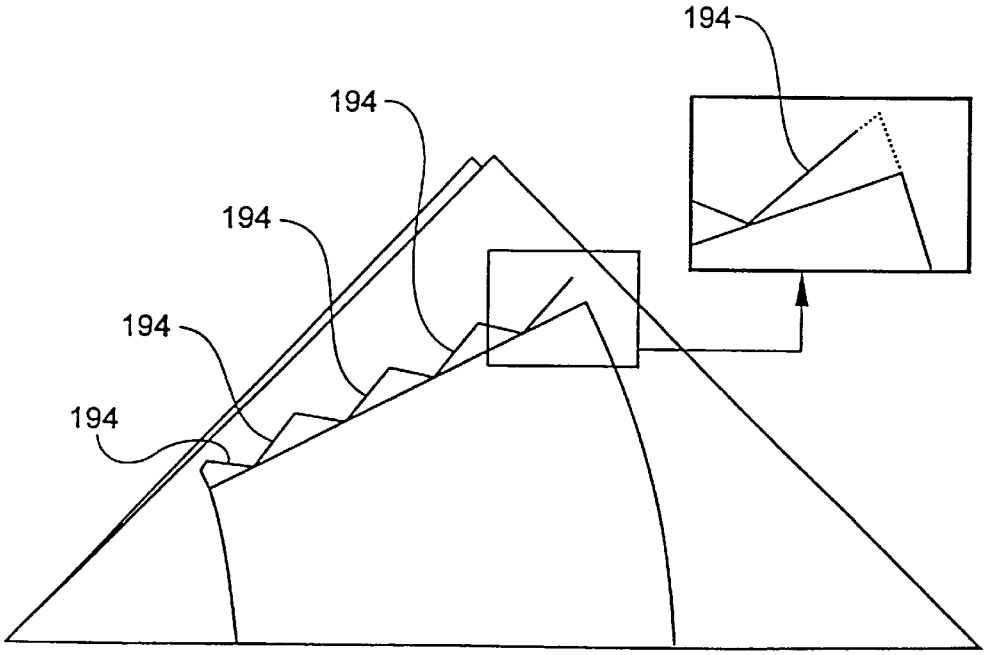
FIG. 24 is a top plan view of the folded fabric of FIG. 22 with further outlines made with the template of FIG. 6.

In order to outline the side edge of the swag body for the cut-out swag, once the second template 78 has been oriented as set forth above, the rest of the first edge 82 of the second template 78 beginning at the intersection of the alignment line 260 with the first side edge 82 of the second template 78 and extending to the second edge 84 is traced as shown in FIG. 23, and the second edge 84 from the intersection with the first edge 82 to the side edge reference line 192 is traced, thereby forming a triangular portion 194 of the side edge of the swag body. Then, as before, the second template 78 is repositioned with reference to the appropriate base line 80 extending along the side edge reference line 192 to form further continuous triangular portions 192 as shown in FIG. 24.

When the last triangular portion 194 is formed, the second template 78 will again extend beyond the end of the outline of the bottom of the swag body as in the formation of the traditional swag. At this point the tracing of the first side edge 82 of the second template 78 is continued in linear manner beyond the intersection of the first edge 82 with the second edge 84, if necessary, and then the end of the bottom outline of the swag body is extended in continuous curved fashion to intersect therewith to form the bottom side corner of the swag body as shown in FIG. 24.

Figure 25:
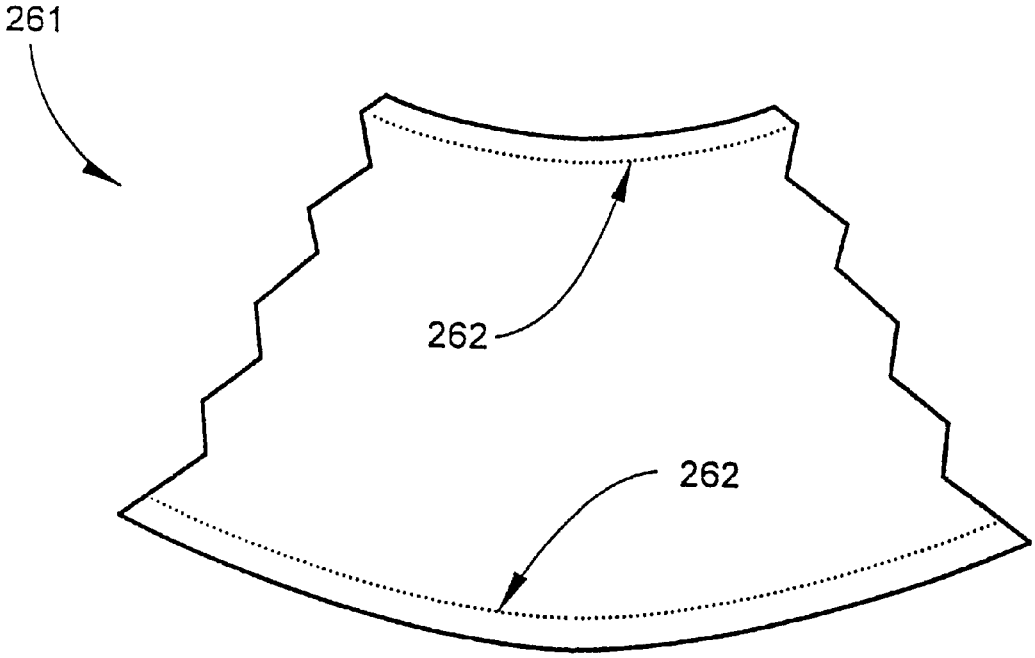
FIG. 25 is a top plan view of a swag body cut from the folded fabric of FIG. 24.

Once the top one-half and bottom one-half and the side of the swag body have been outlined as set forth above, the fabric is folded about the center axis (if not folded previously) and then cut along the outlines to form the cut-out swag body 261 as discussed above. A half inch seam 262 also then can be sewn in the top and bottom of the swag body, all as shown in FIG. 25.

Figure 26:
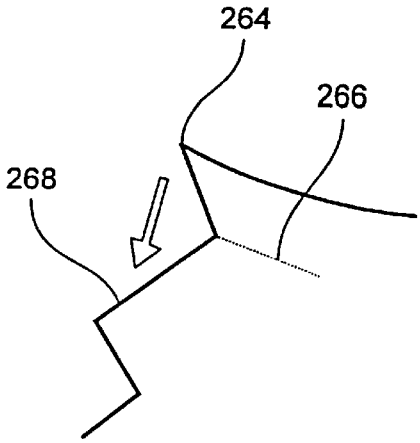
FIG. 26 is a perspective view of the beginning of the folding of the swag body of FIG. 25 to form a pleat.
Figure 27:
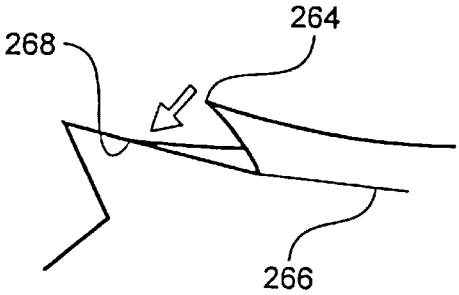
FIG. 27 is a perspective view of the continued folding of a swag body to form a pleat begun in FIG. 26.
Figure 28:
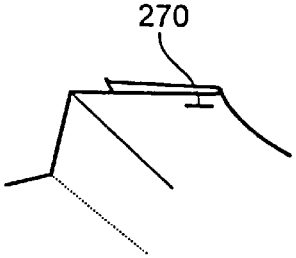
FIG. 28 is a perspective view of the finished fold begun in FIG. 26.

To make the finished cut-out swag therefrom, the swag body 261 is next folded to form pleats and then hung. In particular, each triangular portion 194 formed along the side edges of the swag body are folded to form the pleats. With reference to FIGS. 26–28, the first pleat is preferably formed in somewhat of a different manner than with the traditional swag because of the cut-out portion. Specifically, point 264 is folded downwardly along foldline 266 toward point 268 as shown in FIG. 26. In FIG. 27 the fold is continued with point 264 being tucked under and aligned with point 268. FIG. 28 illustrates that a staple or pin can be attached at 270 to hold the first pleat in place.

Figure 29:
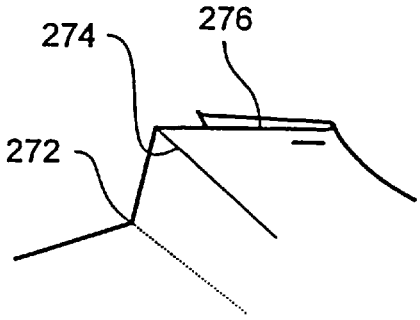
FIG. 29 is a perspective view of the beginning of the folding of the swag body of FIG. 28 to form a second pleat.
Figure 30:
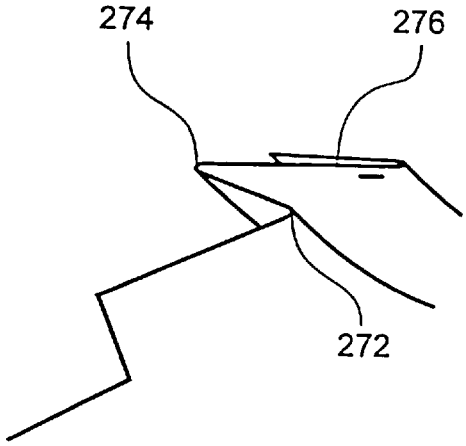
FIG. 30 is a perspective view of the continued folding of a swag body to form a second pleat begun in FIG. 29.
Figure 31:
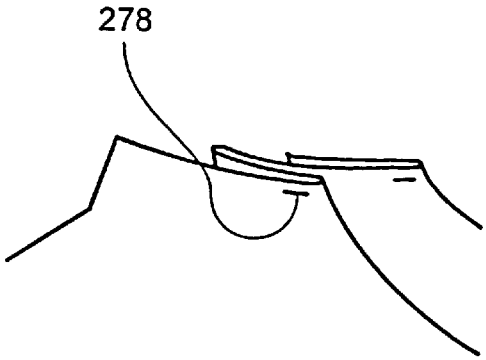
FIG. 31 is a perspective view of the finished fold begun in FIG. 29.

The second and following pleats are formed in the same manner discussed above with respect the traditional swag. In particular, as seen in FIGS. 29 and 30, to form the second pleat the point 272 is folded upwardly along foldline 274 towards point 276, and then another staple or pin is used at 278 to secure the second pleat as shown in FIG. 31.

Figure 32:
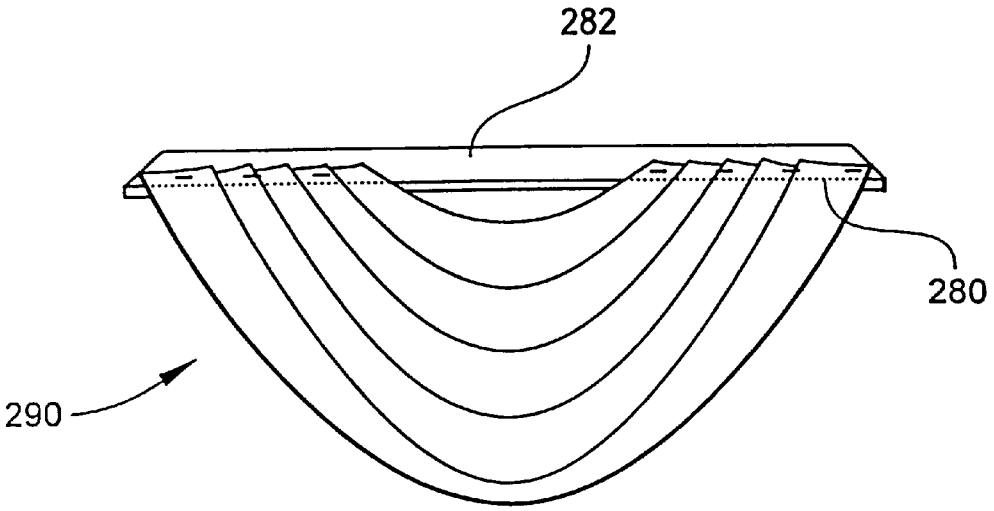
FIG. 32 is an elevational view of a cut-out swag mounted to a mounting board.
Figure 33:
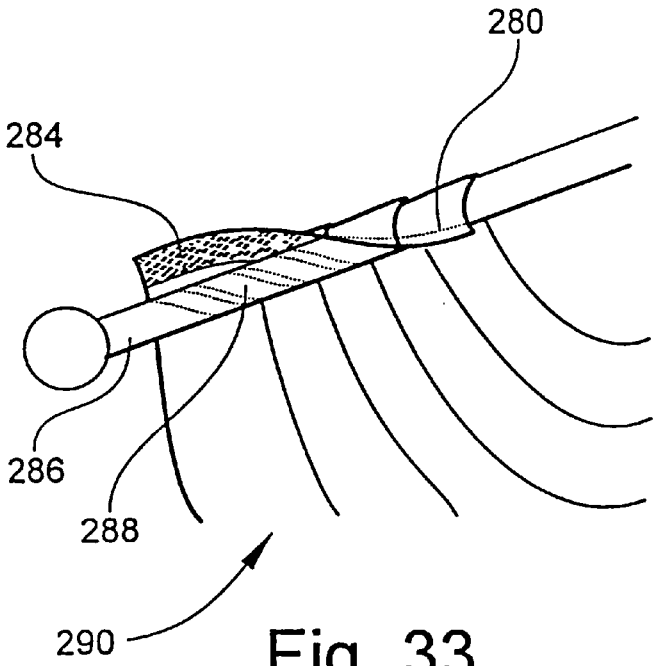
FIG. 33 is a perspective view of a cut-out swag being mounted to a pole.

Once all the pleats are formed, a stitch 280 can be made across the top of the swag body 261 to retain all the pleats in place as shown in FIGS. 32 and 33. As shown in FIG. 32, the swag can then stapled to a mounting board 282 where the pleats are dressed into round folds with the top pleat being worked first. Then, pleat by pleat, the pleats are dressed into round folds. Optionally, a strip of loop tape 284 may be attached to the back of the swag and then attached to a pole 286 having been spirally wrapped with pressure sensitive hook tape 288 as shown in FIG. 33. The swag may then be used, the desired traditional swag 290 having a swag drop of 17" and a swag width of 28" having been formed.

With due regard for tolerances, it has been found that the preferred apparatus and method of the present invention for making swags having selected swag dimensions of width and drop is accurate to within approximately an inch as a result of fabric drapability and stretchability as well as approximations made in location of the indicia of the aforesaid templates.

As can be seen, the present invention provides an efficient and effective apparatus and method for making swags, even by inexperienced persons. It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of outlining a swag body on fabric, comprising:

overlaying a first unadjustable template over the fabric, the first template including indicia for outlining on the fabric a top portion and a bottom portion of the swag body to define a swag having one of a plurality of predetermined swag drops and one of a plurality of predetermined swag widths, said indicia comprising top demarcation lines and bottom demarcation lines with each said top demarcation line identifying one of said plurality of swag drops and each having a plurality of aperture each identifying one of said plurality of said swag widths, and with each said bottom demarcation line identifying one of said plurality of swag drops and each having a plurality of apertures each identifying one of said plurality of swag widths, partially outlining on the fabric with the first template top and bottom portions of the swag body using a selected one of the top demarcation lines, a selected one of the bottom demarcation lines, and at least one aperture in each of the selected top and bottom demarcation lines, overlaying a second unadjustable template over the fabric, and further outlining on the fabric with the second template a side portion of the swag body extending between said top and bottom portions to define a selected number of swag pleats.

2. A method according to claim 1, wherein the first template comprises of a single sheet of material and wherein the second template comprises a single sheet of material.

3. A method according to claim 1, wherein said outlining with the second template includes outlining only the side portion of the swag body.

4. A method according to claim 1, wherein the swag body is that of a cut-out swag.

5. A method according to claim 1, wherein said outlining with the first template includes outlining an upper corner side portion of the swag body, and wherein the swag body is that of a traditional swag.

6. A method according to claim 1, further comprising the step of orienting the first template on the fabric with respect to a center axis of the swag body to be outlined.

7. A method according to claim 6, further comprising first folding the fabric about a foldline whereby the foldline lies collinear with the center axis of the swag body.

8. A method according to claim 1, further comprising marking a side edge reference line on the fabric with the first template and orienting the second template on the fabric with respect to the side edge reference line during said overlaying of the second template.

9. A method according to claim 8, wherein said outlining with the second template includes outlining triangular portions of the swag body, each triangular portion defining an area for folding for forming one of the pleats.

10. A method according to claim 9, wherein said outlining with said second template includes repeatedly positioning the second template along the side edge reference line in adjacent consecutive positions, a said triangular portion being outlined each time the second template is repositioned along the side edge reference line.

11. A method according to claim 1, wherein said outlining with the first template includes outlining one-half of the top of the swag body and substantially one-half of the bottom of the swag body.

12. A method according to claim 11, further comprising outlining an upper corner of the swag body.

13. A method according to claim 12, wherein said outlining with the second template includes outlining the side portion of the swag body from the upper corner of the swag body to the bottom of the swag body.

14. A pair of templates used together for partially outlining a swag body on fabric, comprising:

a first template including indicia for outlining on the fabric a top portion and a bottom portion of the swag body to define a swag having one of a plurality of predetermined swag drops and one of a plurality of predetermined swag widths, said indicia comprising top demarcation lines and bottom demarcation lines with each said top demarcation line identifying one of said plurality of swag drops and each having a plurality of apertures each identifying one of said plurality of said swag widths, and with each said bottom demarcation line identifying one of said plurality of swag drops and each having a plurality of apertures each identifying one of said plurality of swag widths, and a second template including indicia for outlining on the fabric a side portion of the swag body outlined with said first template.

15. The pair of templates according to claim 14, wherein said first template further includes indicia for outlining an upper side corner of the swag body.

16. The pair of templates according to claim 14, wherein the swag body is that of a cut-out swag and wherein said top demarcation lines include curved demarcation lines for outlining the top portion of the swag body.

17. The pair of templates according to claim 16, wherein each said curved demarcation line corresponds to a different swag drop.

18. The pair of templates according to claim 14, wherein said first template further includes a tracing edge for tracing a reference line on the fabric and wherein said indicia on said second template includes base lines for orienting said second template with respect to the reference line traced along said tracing edge of said first template.

19. The pair of templates according to claim 18, wherein each said base line on said second template corresponds to a different swag drop.

20. The pair of templates according to claim 14, wherein said second template includes an angular side edge for outlining triangular portions for defining the side portion of the swag body.

21. The pair of templates according to claim 20, wherein said second template is dimensioned to outline a predetermined number of triangular portions defining the side portion of the swag body, the predetermined number of triangular portions corresponding to a predetermined number of swag pleats.

22. The pair of templates according to claim 14, wherein said first template is planar and said second template is planar.

23. The pair of templates according to claim 14, wherein said first template consists of a single sheet of material and said second template consists of a single sheet of material.

24. The pair of templates according to claim 14, wherein said first template consists of a single sheet of plastic and said second template consists of a single sheet of plastic.

25. A method of outlining swag bodies on fabric, comprising:

partially outlining with a first unadjustable template top and bottom portions of a first plurality of swag bodies, each of the first plurality of swag bodies defining a swag having a different swag drop but same swag width, wherein each of the first plurality of swag bodies has a side edge reference line of a different length extending along a side thereof, and defining an identical number of pleats for each side of the first plurality of swag bodies by aligning a second unadjustable template along the side edge reference line of each of the first plurality of swag bodies and outlining a corner portion of the second unadjustable template.

26. The method of claim 25, wherein the first and the second templates are planar.

27. The method of claim 25, wherein the first template consists of a single sheet of material and wherein the second template consists of a single sheet of material.

28. The method of claim 25, wherein the first template comprises a single sheet of durable plastic and wherein the second template comprises a single sheet of durable plastic.

29. The method of claim 25, wherein at least one of the first plurality of swag bodies defines a cut-out swag and at least one of the first plurality of swag bodies defines a traditional swag.

30. The method of claim 29, further comprising partially outlining with the first template top and bottom portions of a second plurality of swag bodies, each of the second plurality of swag bodies defining a swag having a different swag drop but same swag width, wherein the swag width of the second plurality of swag bodies is different from the swag width of the first plurality of swag bodies, and further outlining with a third template side portions of the second plurality of swag bodies to define an identical number of pleats for each of the second plurality of swag bodies.

31. An apparatus for partially outlining a swag body on fabric, comprising an unadjustable template including indicia for outlining on the fabric a top portion and a bottom portion of the swag body to define a swag having one of a plurality of predetermined swag drops and one of a plurality of predetermined swag widths, said indicia comprising top demarcation lines and bottom demarcation lines with each said top demarcation line identifying one of said plurality of swag drops and each having a plurality of apertures each identifying one of said plurality of said swag widths, and with each said bottom demarcation line identifying one of said plurality of swag drops and each having a plurality of apertures each identifying one of said plurality of swag widths.

32. The apparatus of claim 31, wherein said template is planar.

33. The apparatus of claim 31, wherein said template consists of a single sheet of material.

34. The apparatus of claim 31, wherein said template comprises of a single sheet of durable plastic.

35. An apparatus for partially outlining side portions of swag bodies on fabric, each swag body defining a swag having a different swag drop but identical number of pleats, comprising an unadjustable template having a corner with indicia defining different size corner portions, each corner portion for outlining between a top portion and bottom portion of a different one of said swag bodies a predetermined number of protruding portions defining the side edge thereof with the predetermined number of protruding portions corresponding to the identical number of pleats for each of the swags.

36. The apparatus of claim 35, wherein said protruding portions each comprises a triangular portion.

37. The apparatus of claim 35, wherein said template is planar.

38. The apparatus of claim 35, wherein said template consists of a single sheet of material.

39. The apparatus of claim 35, wherein said template comprises of a single sheet of durable plastic.

40. A method of outlining swag bodies on fabric, comprising:

providing a first unadjustable template including a top demarcation line and a bottom demarcation line for outlining respectively a top portion and a bottom portion of a plurality of swag bodies, each demarcation line having a plurality of aperture each corresponding a different swag width, partially outlining with the top and bottom demarcation lines the top and bottom portions of the plurality of swag bodies, wherein the outlining for each swag body uses a different one of the apertures to define swag each having a different swag width but same swag drop, and defining an identical number of pleats for each of the plurality of swag bodies by aligning a second unadjustable template along the side of each of the plurality of swag bodies and outlining a corner portion of said second unadjustable template.

41. The method of claim 40, wherein the first and the second templates are planar.

42. The method of claim 40, wherein the first template consists of a single sheet of material and wherein the second template consists of a single sheet of material.

43. The method of claim 40, wherein the first template comprises a single sheet of durable plastic and wherein the second template comprises a single sheet of durable plastic.

44. The method of claim 40, wherein at least one of the first plurality of swag bodies defines a cut-out swag and at least one of the first plurality of swag bodies defines a traditional swag.

45. The method of claim 40, further comprising partially outlining with the first template top and bottom portions of a second plurality of swag bodies, each of the second plurality of swag bodies defining a swag having a different swag width but same swag drop, wherein the swag drop of the second plurality of swag bodies is different from the swag drop of the first plurality of swag bodies, and further outlining with a third template side portions of the second plurality of swag bodies to define an identical number of pleats for each of the second plurality of swag bodies.

* * * * *

UNITED STATES PATENT AND TRADEMARK OFFICE

CERTIFICATE OF CORRECTION

PATENT NO. : 6,108,918
DATED : August 29, 2000
INVENTOR(S) : Ye

It is certified that error appears in the above-identified patent and that said Letters Patent is hereby corrected as shown below:

Title page,
Item [56] Other Publications, second item, delete "Cornfab, for 'Cornfabl'" and insert therefor -- Comfab, for Comfab 1 --

Column 4,
Line 10, delete "swag-cut out" and insert therefor -- swag cut-out --

Column 9,
Line 44, delete "marking" and insert therefor -- markings --
Last line, delete "lines" and insert therefor -- line --.

Column 13,
Line 20, delete "cutout" and insert therefor -- cut-out --

Column 14,
Line 42, after "respect" insert -- to --.
Line 50, after "then" insert -- be --

Column 15,
Line 32, delete "aperture" and insert therefor -- apertures --
Line 49, after "comprises" delete -- of --

UNITED STATES PATENT AND TRADEMARK OFFICE

CERTIFICATE OF CORRECTION

PATENT NO. : 6,108,918
DATED : August 29, 2000
INVENTOR(S) : Ye

It is certified that error appears in the above-identified patent and that said Letters Patent is hereby corrected as shown below:

Column 18,
Line 23, delete "comprises" and insert therefor -- consists --
Line 30, delete "aperture" and insert therefor -- apertures --
Line 30, after "corresponding" insert -- to --
Line 35, delete "swag" and insert therefor -- swags, --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*